US007986098B2

(12) United States Patent
Tada et al.

(10) Patent No.: US 7,986,098 B2
(45) Date of Patent: Jul. 26, 2011

(54) CATHODE POTENTIAL CONTROL DEVICE, SELF-LUMINOUS DISPLAY DEVICE, ELECTRONIC EQUIPMENT AND CATHODE POTENTIAL CONTROL METHOD

(75) Inventors: Mitsuru Tada, Kanagawa (JP); Atsushi Ozawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 716 days.

(21) Appl. No.: 12/149,554

(22) Filed: May 5, 2008

(65) Prior Publication Data

US 2008/0290806 A1 Nov. 27, 2008

(30) Foreign Application Priority Data

May 25, 2007 (JP) ..... 2007-139768

(51) Int. Cl.
*G09G 3/10* (2006.01)

(52) U.S. Cl. ..... 315/169.3; 315/291; 315/307

(58) Field of Classification Search ..... 315/32, 315/33, 105–107, 94, 112, 117, 118, 169.3, 315/169.4, 291, 307, 308, 309
See application file for complete search history.

(56) References Cited

U.S. PATENT DOCUMENTS

2005/0068270 A1* 3/2005 Awakura et al. ..... 345/76

FOREIGN PATENT DOCUMENTS

| | | |
|---|---|---|
| JP | 2003-134418 | 5/2003 |
| JP | 2003-330419 | 11/2003 |
| JP | 2006-030318 | 2/2006 |

* cited by examiner

*Primary Examiner* — Douglas W Owens
*Assistant Examiner* — Jianzi Chen
(74) *Attorney, Agent, or Firm* — Rader, Fishman & Grauer PLLC

(57) ABSTRACT

Disclosed herein is a cathode potential control device for controlling a common cathode potential applied to a self-luminous display panel adapted to drive and control the light emission status of each of the pixels by active matrix driving, the cathode potential control device including: a cathode potential determination section adapted to read a cathode potential level from a table memory according to a current panel temperature, the cathode potential level being associated with a panel temperature so as to cancel the temperature dependent characteristic of a voltage which develops between anode and cathode electrodes of a self-luminous element during light emission, the level causing a drive transistor of the self-luminous element to operate in the saturation region; and a cathode potential application section adapted to develop a cathode potential associated with the determined cathode potential level and supply the potential to a common cathode electrode of the self-luminous display panel.

9 Claims, 28 Drawing Sheets

FIG. 8

| TEMPERATURE [℃] | CATHODE POTENTIAL [V] |
|---|---|
| -10 | 3 |
| -9 | 2.8 |
| . | . |
| . | . |
| . | . |
| 59 | 1.1 |
| 60 | 1 |

FIG.19

| Vel [V] | TEMPERATURE [℃] |
|---|---|
| 9.3 | -10 |
| 9.2 | -9 |
| . | . |
| . | . |
| . | . |
| 7.1 | 59 |
| 7 | 60 |

CATHODE POTENTIAL CONTROL DEVICE, SELF-LUMINOUS DISPLAY DEVICE, ELECTRONIC EQUIPMENT AND CATHODE POTENTIAL CONTROL METHOD

CROSS REFERENCES TO RELATED APPLICATIONS

The present invention contains subject matter related to Japanese Patent Application JP 2007-139768 filed with the Japan Patent Office on May 25, 2007, the entire contents of which being incorporated herein by reference.

BACKGROUND OF THE INVENTION

1. Field of the Invention

The invention described herein relates to a technique for controlling a common cathode potential applied to a self-luminous display panel adapted to drive and control the light emission status of each of the pixels by active matrix driving, so as to optimize the display panel power consumption according to the drive temperature.

It should be noted that the present invention has features as a cathode potential control device, self-luminous display device, electronic equipment and cathode potential control method.

2. Description of the Related Art

A variety of types of flat panel displays are commercially available today. One among such flat panel displays is an organic EL panel having organic EL (Electro Luminescence) elements arranged in a matrix form in the display region. An organic EL panel not only is easy to be reduced in thickness but also has a high response speed and excellent moving image display characteristic. Thus, such a panel offers a variety of features necessary for the next-generation of devices.

Incidentally, the current-voltage (I-V) characteristic of the organic EL elements is known to change according to the drive temperature. It should be noted that the drive temperature changes constantly depending on the ambient temperature and heat generation from the organic EL elements themselves. It has been pointed out therefore that the light emission brightness of the organic EL elements changes constantly depending on the drive temperature.

SUMMARY OF THE INVENTION

Several examples of the techniques will be described below which can change the light emission brightness (peak brightness level) of the display panel although the ideas behind them differ from that of the invention proposed by the inventors.

Japanese Patent Laid-Open No. 2003-134418 referred to as Patent Document 1 hereinafter discloses a technique for suppressing the peak brightness level so as to suppress the power consumption. However, the technique does not take into consideration the temperature dependent characteristic of the organic EL elements. Further, the technique may not provide reduced power consumption if the peak brightness level is maintained constant.

Japanese Patent Laid-Open No. 2003-330419 referred to as Patent Document 2 hereinafter discloses an arrangement for correcting the display data to achieve a proper brightness by referring, based on the detected ambient temperature, to the voltage-current characteristic of the light-emitting elements stored in a device. However, this technique leads to a smaller number of gray levels of the display data, thus making it difficult to maintain high image quality.

Japanese Patent Laid-Open No. 2006-030318 referred to as Patent Document 3 hereinafter discloses an arrangement for changing the peak brightness level according to the brightness of external light. More specifically, the disclosed arrangement variably controls a cathode potential Vcathode according to the brightness of external light so that the voltage between a source potential Vcc and the cathode potential is reduced.

However, the purpose of the arrangement is to change the characteristic between a drain voltage Vd and drain current Id of the drive transistor, thus reducing the peak brightness level even if a gate-to-source voltage Vgs remains unchanged. That is, the impact of the temperature dependent characteristic of the light-emitting elements is not considered. Further, the peak brightness level has to indispensably change. As a result, the power consumption may not be reduced without reducing the peak brightness level.

Hence, the inventors propose an arrangement for controlling, to a necessary minimum level, the power consumption of the display panel according to the temperature dependent characteristic of the self-luminous elements without changing the light emission status (peak brightness level). More specifically, the inventors propose an arrangement for controlling the cathode potential of the display panel to its optimal level.

That is, the inventors include two sections in a control device. The control device controls a common cathode potential applied to a self-luminous display panel. The self-luminous display panel drives and controls the light emission status of each of the pixels by active matrix driving. One of the two sections or section (a) is a cathode potential determination section. The same section reads a cathode potential level from a table memory according to a current panel temperature. The cathode potential level is associated with the panel temperature so as to cancel the temperature dependent characteristic of a voltage which develops between anode and cathode electrodes of a self-luminous element during light emission. The cathode potential level causes a drive transistor of the self-luminous element to operate in the saturation region. The other section or section (b) is a cathode potential application section. The same section develops a cathode potential associated with the determined cathode potential level and supplies the potential to a common cathode electrode of the self-luminous display panel.

The invention proposed by the inventors can variably control the common cathode potential so as to cancel the temperature dependent characteristic of the voltage which develops between the anode and cathode electrodes of the self-luminous element during light emission. For example, the invention can reduce the common cathode potential at a temperature where the voltage developing between the anode and cathode electrodes is small. On the other hand, the invention can increase the common cathode potential at a temperature where the voltage developing therebetween is large.

This makes it possible to variably control the voltage applied to the display panel (voltage applied between the source potential Vcc and cathode potential) according to the change of the drive temperature. That is, a minimum voltage necessary for the light emission at each drive temperature can be applied to the display panel. This ensures optimal power consumption of the display panel based on the change of the drive temperature.

BRIEF DESCRIPTION OF THE DRAWINGS

FIG. 8 is a view illustrating an example of a correspondence table storing the correspondence between a measured temperature and cathode potential level;

FIG. 19 is a view illustrating an example of a table associating a measured anode potential and drive temperature;

DETAILED DESCRIPTION OF THE PREFERRED EMBODIMENTS

Figure 1:
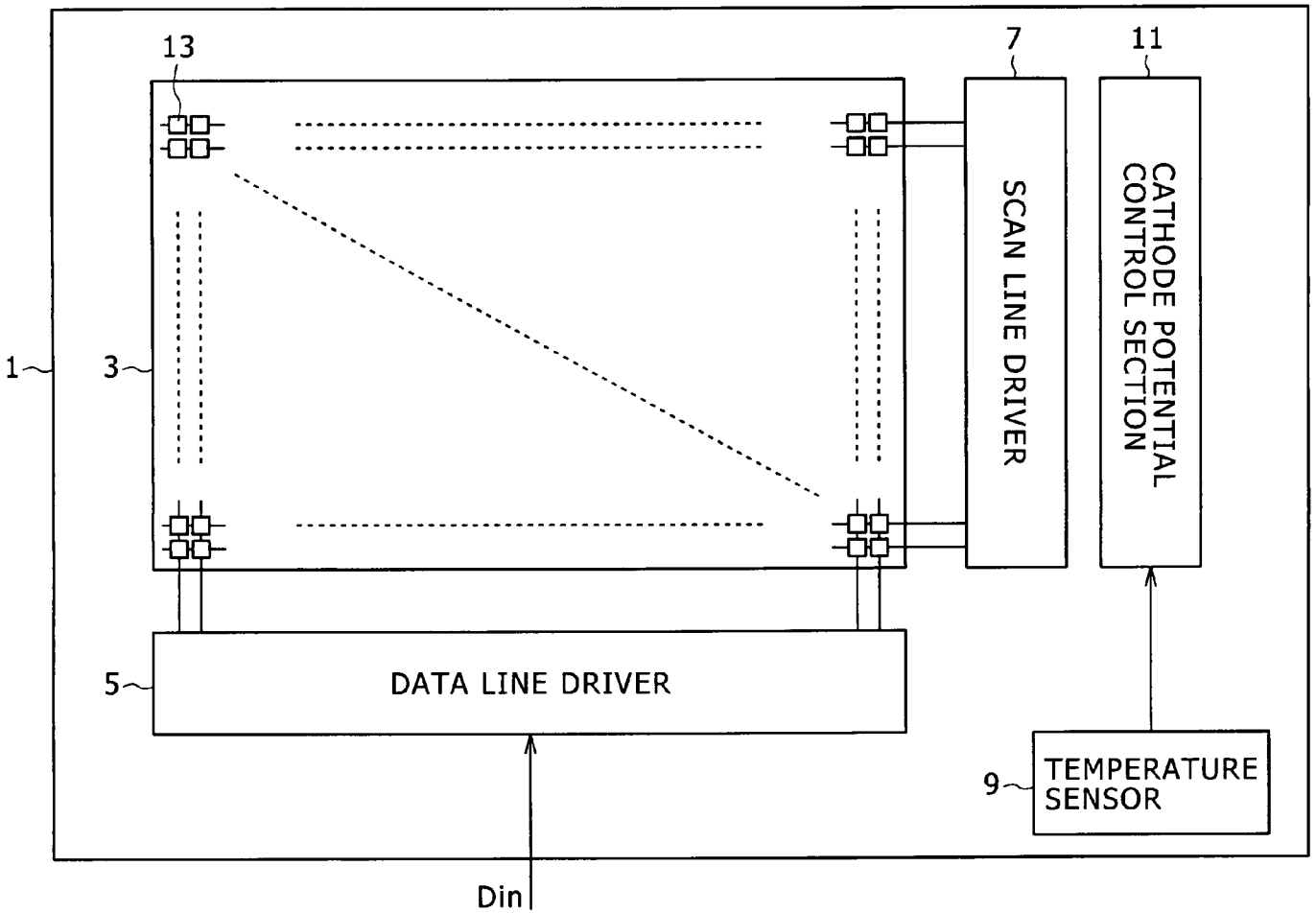
FIG. 1 is a view illustrating a circuit configuration of an organic EL panel module.

A description will be given below of cases in which the present invention is applied to the cathode potential control of an active-matrix-driven organic EL panel module.

It should be noted that well-known or publicly known techniques of the pertaining technical field are used for the details not illustrated in the drawings or described in the specification.

It should also be noted that the embodiments described herein are illustrative of the invention and not limiting.

(A) Embodiment 1

(A-1) Overall Configuration

FIG. 1 illustrates major components of an organic EL panel module 1. The same module 1 includes an organic EL panel 3, data line driver 5, scan line driver 7, temperature sensor 9 and cathode potential control section 11 as its major components.

The organic EL panel 3 is a display device having pixel circuits arranged in a matrix form according to the panel resolution. The pixel circuits drive and control the light emission status of pixels 13.

In the present embodiment, the organic EL panel 3 is designed for color display. The pixels 13 are arranged according to the arrangement of emission colors. It should be noted, however, that if the pixel 13 includes an organic EL element which has a plurality of organic light-emitting layers of different colors stacked one on top of the other, a single pixel is associated with a plurality of emission colors.

Figure 2:
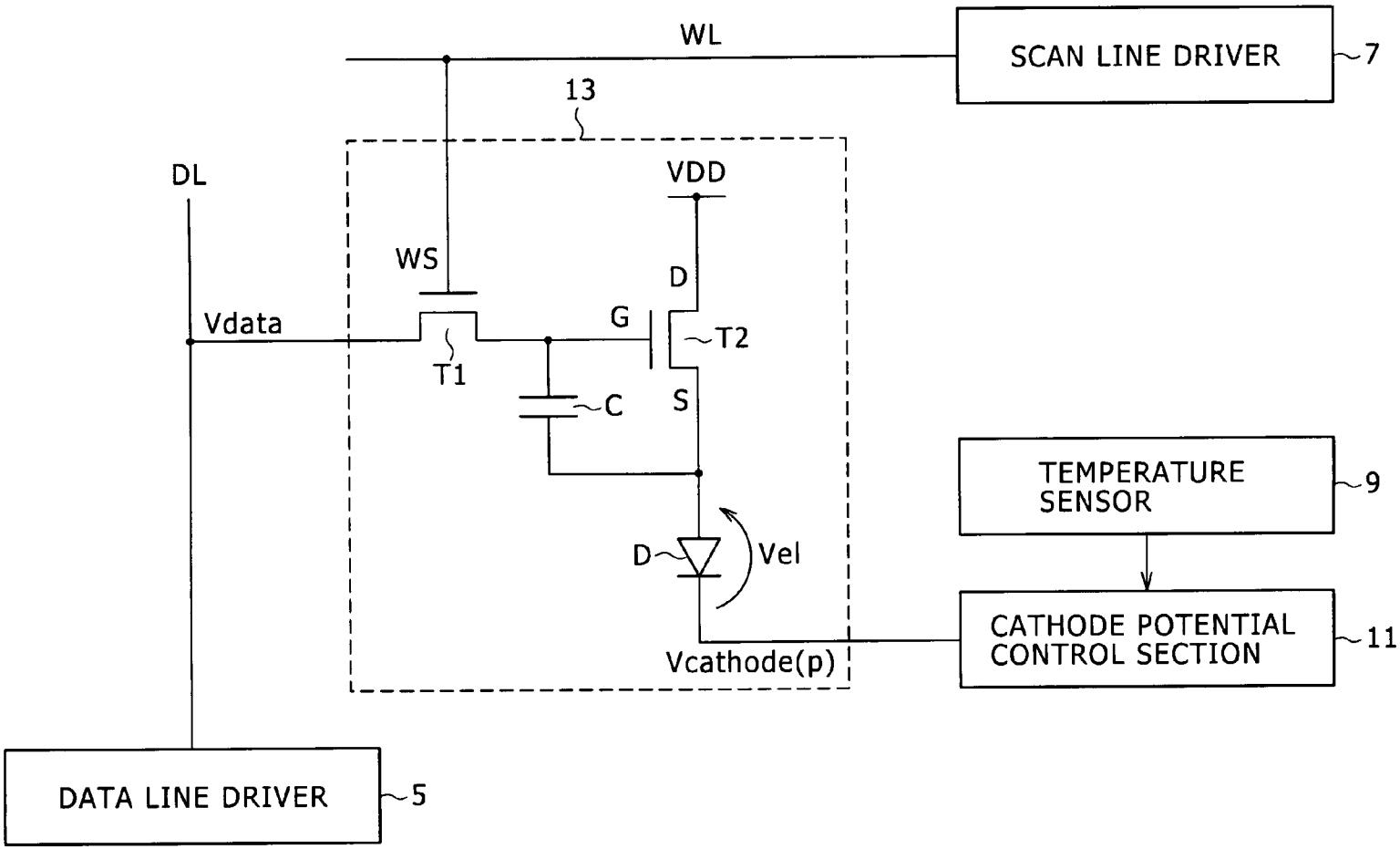
FIG. 2 is a view illustrating the connection between a pixel circuit and peripheral circuitry.

FIG. 2 illustrates an example of structure of the pixel circuit, with the basic structure for active matrix driving. However, a practical pixel circuit may also include, for example, a transistor adapted to control the light emission period, another transistor to correct the threshold of the drive transistor, and yet another transistor that performs mobility correction function.

The pixel 13 in FIG. 2 includes a write control transistor T1, charge holding capacitor C, current-driving transistor T2, and organic EL element D.

The write control transistor T1 is a thin film transistor adapted to control the writing of a signal voltage Vdata to the charge holding capacitance C. The signal voltage Vdata is associated with pixel data.

It should be noted that the opening and closing of the same transistor T1 is controlled by a write signal WS. The same signal WS is supplied from the scan line driver 7 via a scan line WL. The pixel data (signal voltage Vdata) applied via a data line DL is written to the charge holding capacitance C while the same transistor T1 is closed.

The current-driving transistor T2 is a thin film transistor adapted to supply a drive current to the organic EL element D. The magnitude of the drive current is commensurate with the signal voltage Vdata written to the charge holding capacitor C. In the case of FIG. 2, an N-channel field effect transistor is used as the current-driving transistor T2.

The data line driver 5 is a circuit device adapted to apply the pixel data (signal voltage Vdata) associated with each of the pixels to the associated data line DL. The application of the signal voltage Vdata associated with each of the pixels is switched every horizontal scan period.

The scan line driver 7 is a circuit device adapted to give a write timing of the signal voltage Vdata. The scan lines WL which supply a write timing are switched one after another every horizontal scan period.

Figure 3:
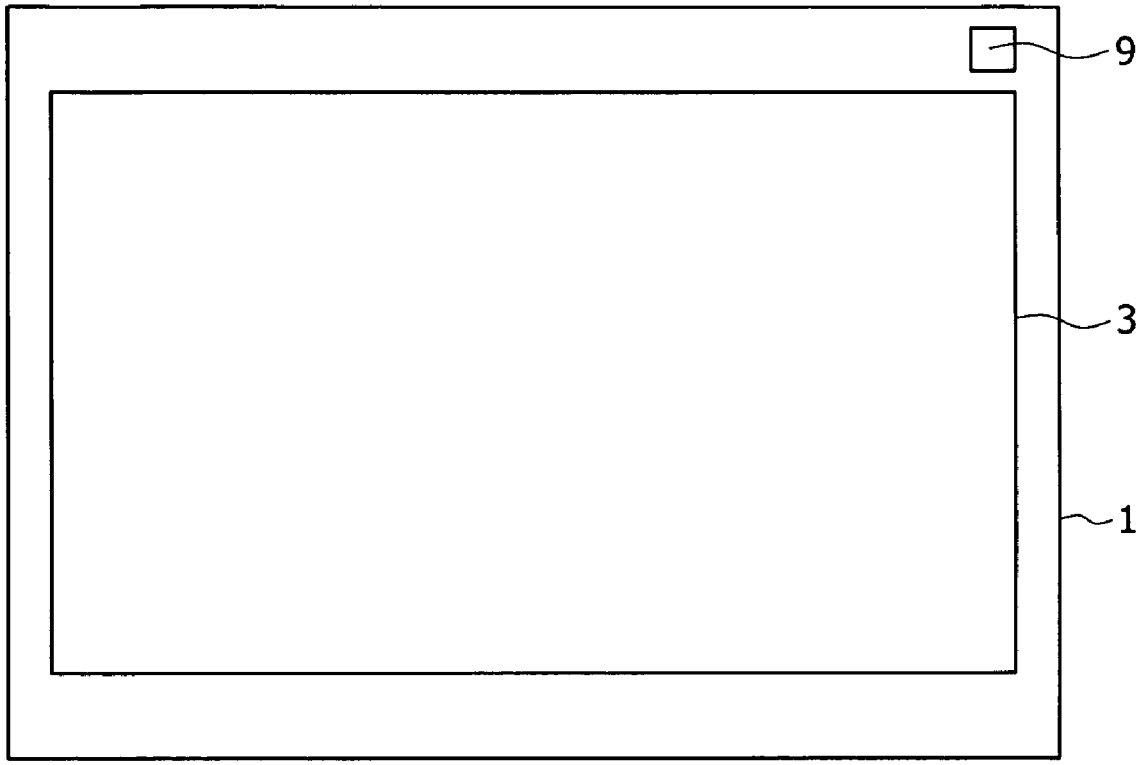
FIG. 3 is a view illustrating an example of arrangement of a temperature sensor.

The temperature sensor 9 is a device adapted to measure the drive temperature of the organic EL panel 3 as the surface temperature of the same panel 3. FIG. 3 illustrates an arrangement example of the temperature sensor 9. In the case of FIG. 3, the temperature sensor 9 is arranged as close to the organic EL panel 3 as possible. However, the temperature sensor may be arranged not only on the same side but also on the opposite or other side of the display region. It should be noted that the temperature sensor 9 has to be located where it can directly or indirectly measure the drive temperature of the organic EL panel 3.

The cathode potential control section 11 is a circuit device adapted to determine a cathode potential to cancel the temperature dependent characteristic of a voltage Vel which develops between the anode and cathode electrodes of the organic EL element D. The same section 11 does so based on the drive temperature (measured temperature) measured by the temperature sensor 9. The same section 11 also applies a cathode potential associated with the determined potential to the common cathode electrode of the organic EL panel 3.

Figure 4:
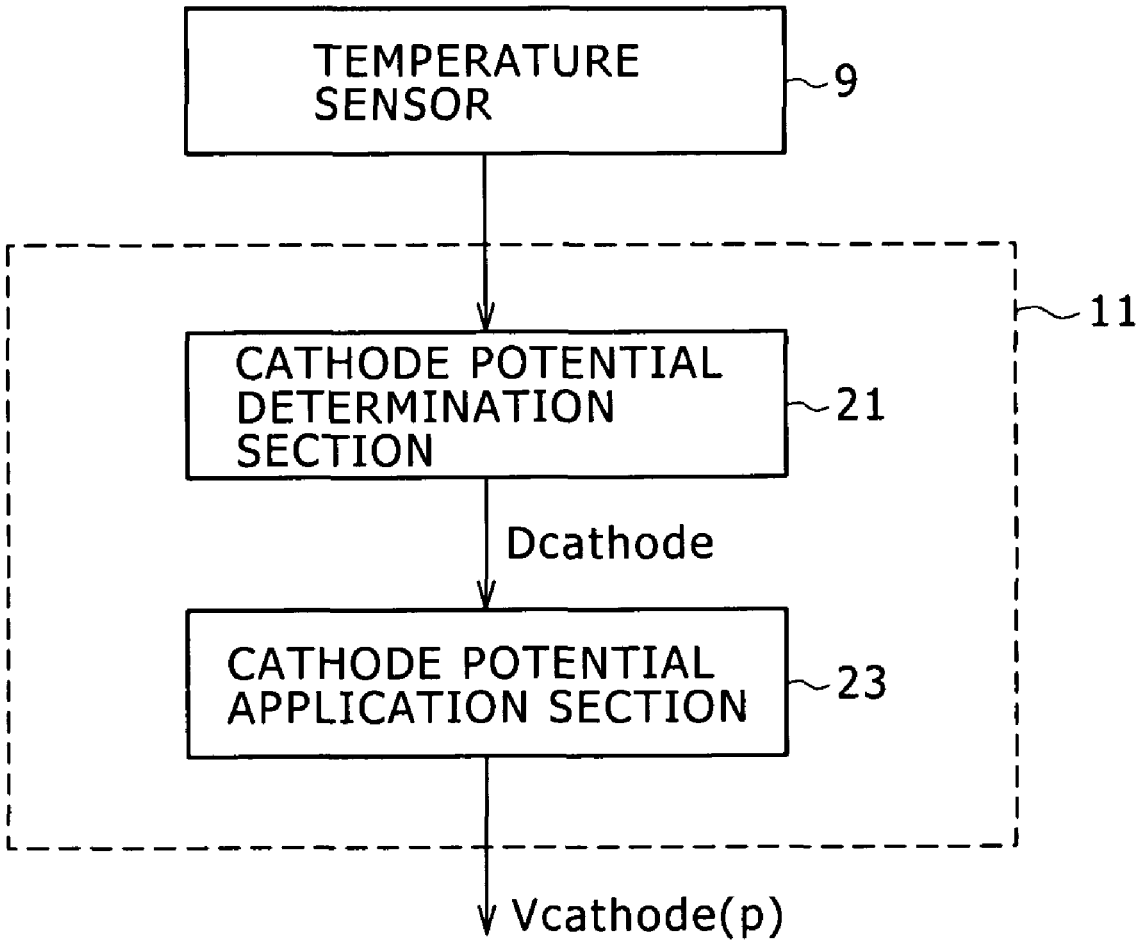
FIG. 4 is a view illustrating an example of internal configuration of a cathode potential control section.

FIG. 4 illustrates an example of internal configuration of the cathode potential control section 11. The same section 11 includes a cathode potential determination section 21 and cathode potential application section 23.

The cathode potential determination section 21 is a processing device adapted to read a cathode potential from a table memory. The cathode potential is set so as to cancel the temperature dependent characteristic of the organic EL element D. The cathode potential is also determined so as to ensure the operation of the current-driving transistor T2 in the saturation region.

Figure 5:
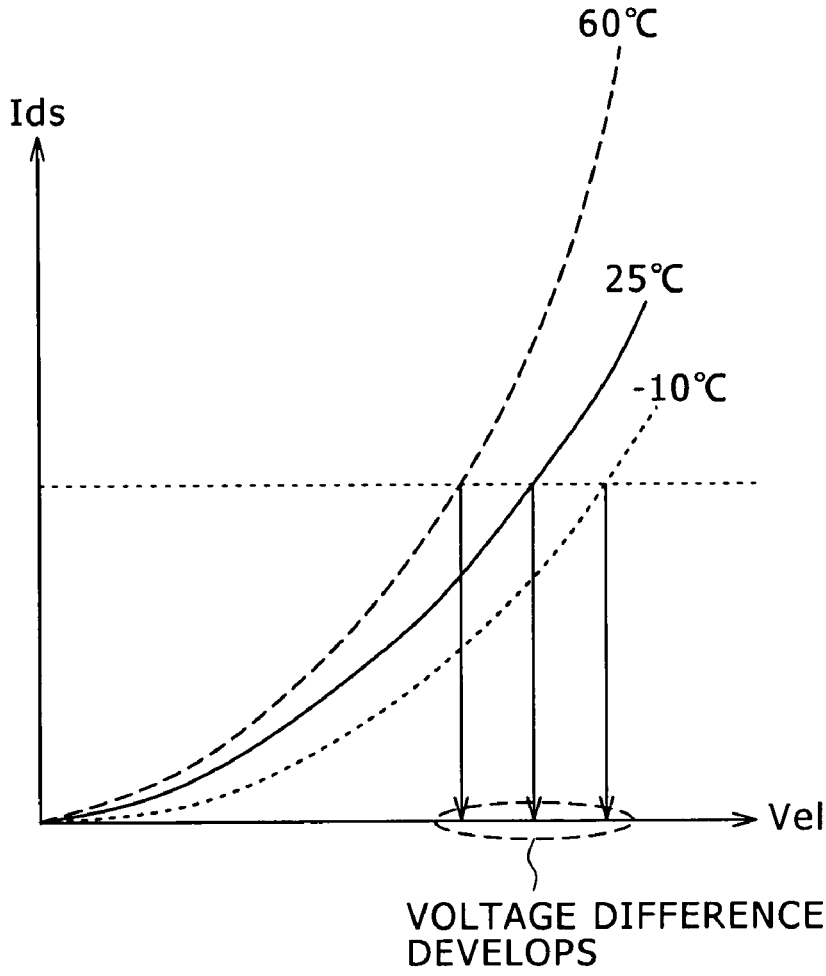
FIG. 5 is a view describing the temperature dependent characteristic of a cathode-to-anode voltage.

FIG. 5 illustrates the temperature dependent characteristic existing between a drive current Ids and the voltage Vel which develops between the anode and cathode electrodes of the organic EL element D during light emission. As illustrated in FIG. 5, the voltage Vel developing between the two electrodes of the organic EL element D changes at different drive temperatures even if the drive current Ids supplied to the current-driving transistor T2 (even if the pixel data) remains unchanged.

Figure 6:
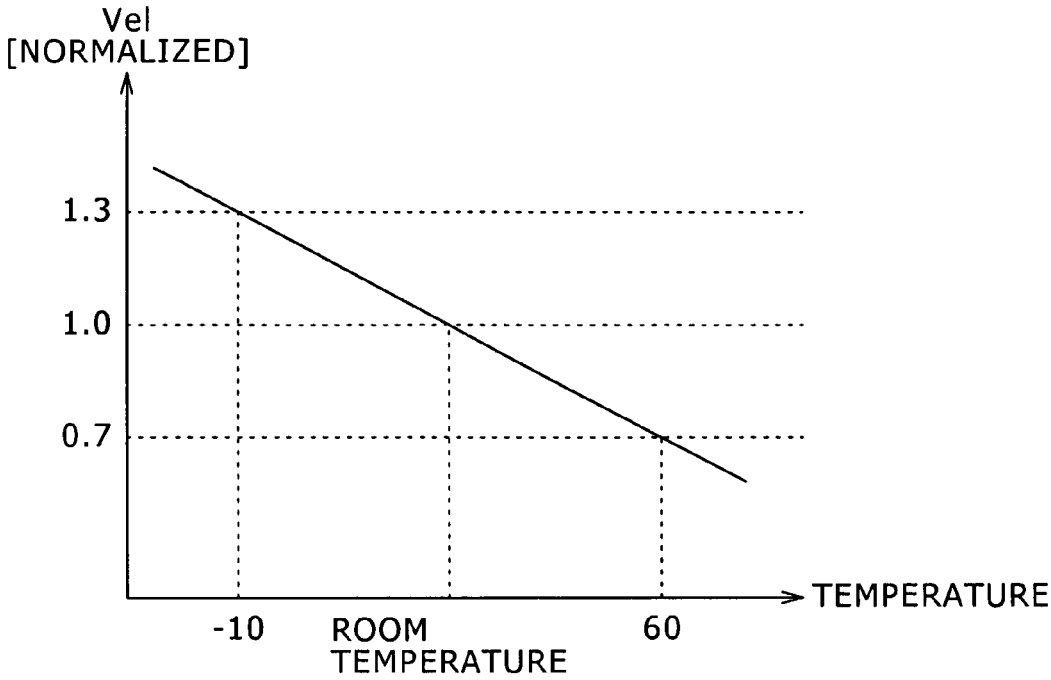
FIG. 6 is a view describing the temperature dependent characteristic of the cathode-to-anode voltage.

FIG. 6 illustrates the relationship between the voltage Vel and drive current. It is clear from FIG. 6 that the lower the drive temperature, the higher the voltage Vel, and the higher the drive temperature, the lower the voltage Vel. It should be noted that the vertical axis represents the normalized voltage Vel.

Figure 7:
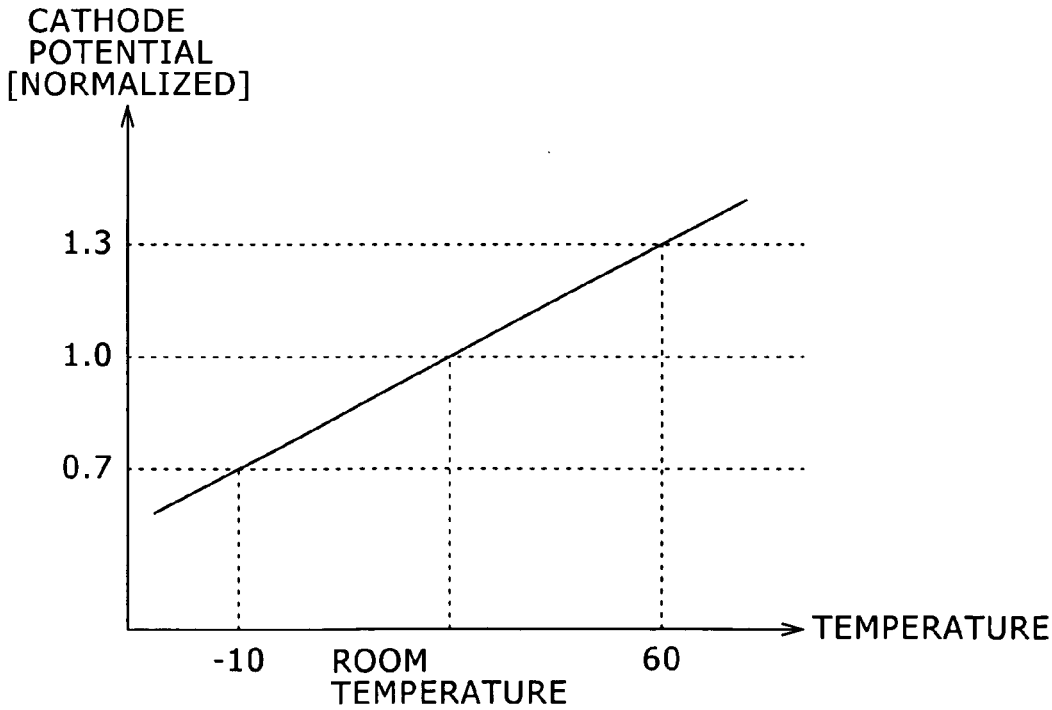
FIG. 7 is a view describing the control characteristic necessary for a cathode potential adapted to cancel the temperature dependent characteristic.

FIG. 7 illustrates the relationship between the cathode potential and temperature. This cathode potential is the level necessary to cancel the temperature dependent characteristic of the voltage Vel developing between the two electrodes of the organic EL element D.

As illustrated in FIG. 7, the lower the drive temperature, the lower the cathode potential is set, and the higher the drive temperature, the higher the cathode potential is set. That is, the cathode potential is set to change in a manner inverse to the change of the voltage Vel which develops between the anode and cathode electrodes of the organic EL element D. This makes it possible to control the potential of the anode electrode of the organic EL element D almost at a constant level. It should be noted that the vertical axis represents the normalized cathode potential.

FIG. 8 illustrates an example of a correspondence table which stores the measured drive temperature used by the cathode potential determination section 21 in association with the cathode potential. In the case of FIG. 8, the measured temperature of −10° C. is associated with the cathode potential of 3 V, and the measured temperature of 60° C. with the cathode potential of 1 V. Thus, the temperature change of 70° C. is associated with the cathode potential change of 2 V.

Naturally, this correspondence is established so that the current-driving transistor T2 continues to operate in the saturation region. That is, the correspondence is established so that the voltage applied between the drain and source electrodes of the current-driving transistor T2 falls within the saturation region. This makes it possible to determine the magnitude of the drive current Ids simply by the magnitude of the signal voltage Vdata. That is, the relationship between the pixel data (signal voltage Vdata stored in the charge holding capacitance C) and drive current Ids can be kept constant irrespective of any temperature change.

The cathode potential application section 23 is a circuit device adapted to develop a common cathode potential Vcathode(p) which is associated with the cathode potential determined according to the measured temperature (read from the correspondence table) and adapted to apply the potential Vcathode(p) to the common cathode electrode of the organic EL panel 3.

Figure 9:
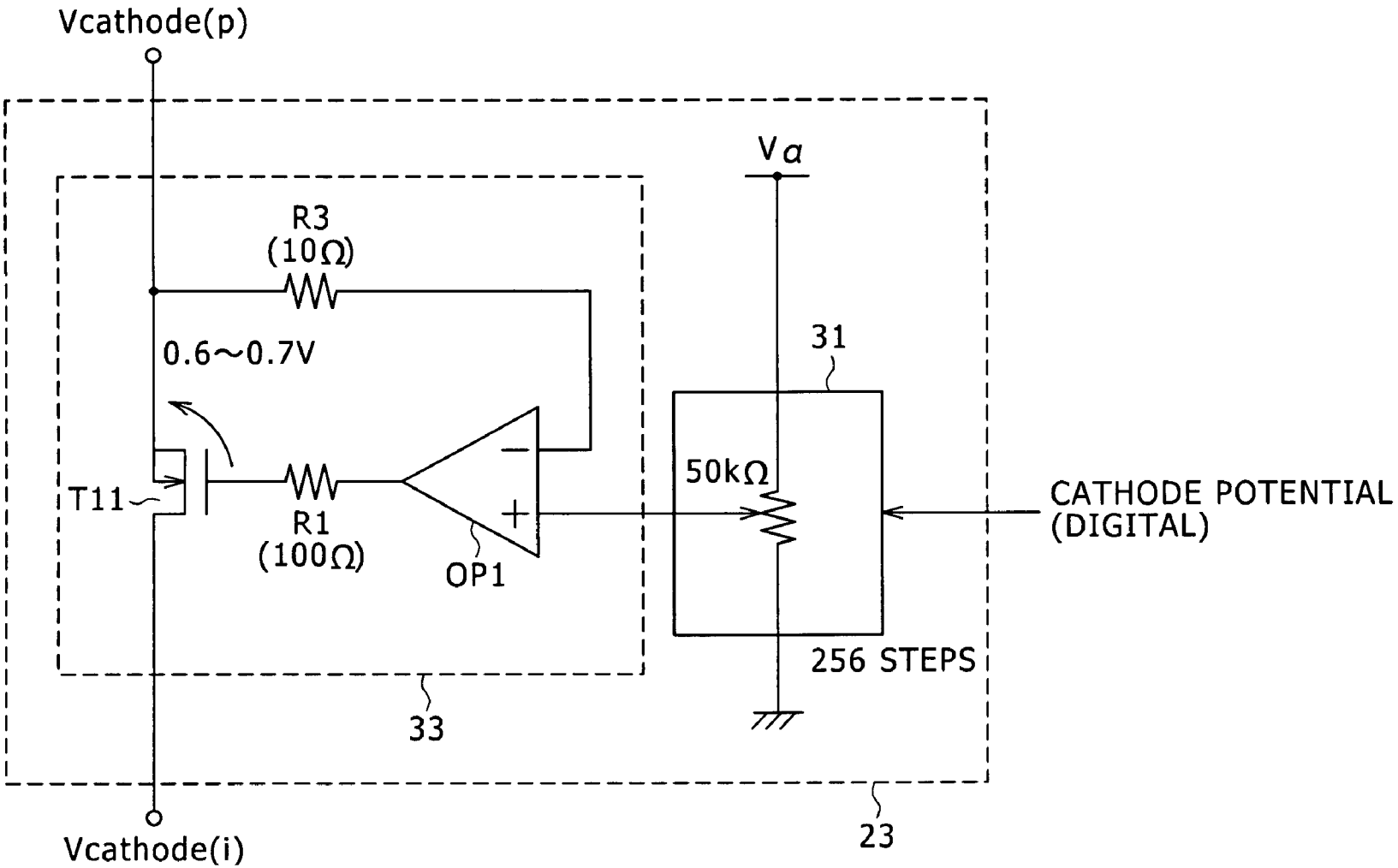
FIG. 9 is a view illustrating an example of internal configuration of a cathode potential application section.

FIG. 9 illustrates an example of internal configuration of the cathode potential application section 23.

The cathode potential application section 23 shown in FIG. 9 includes a digital potentiometer 31 and voltage follower circuit (op-amp OP1, resistances R1 and R3 and N-channel field effect transistor T11) 33.

The digital potentiometer 31 includes, for example, a semi-fixed resistor adapted to generate a voltage in 256 steps (8 bits). It should be noted that a reference cathode potential Vcathode(i) is applied to the source electrode of the field effect transistor T11. The reference cathode potential Vcathode(i) serves as a reference potential.

This circuit configuration makes it possible to maintain the potential of wiring connected to the common cathode electrode of the organic EL panel 3 at the same level as the common cathode potential Vcathode(p) applied by the digital potentiometer 31.

Figure 10:
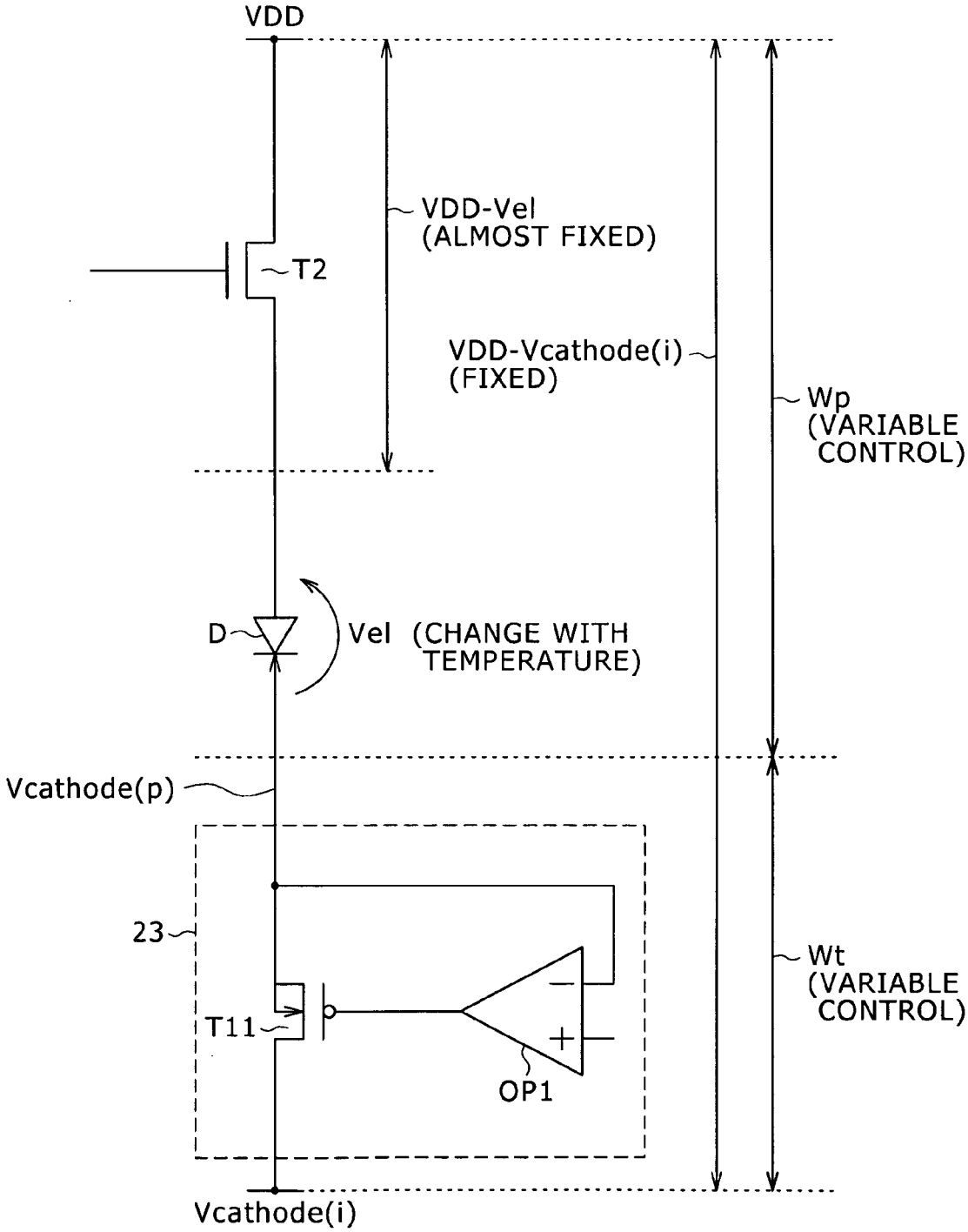
FIG. 10 is a view describing the distribution of power consumption by variable control of the cathode potential.

(A-2) Observation of the Light Emission Status and Power Consumption of the Organic EL Panel FIG. 10 describes the relationship in power consumption between the organic EL panel 3, which is controlled by the cathode potential control section 11, and the cathode potential application section 23.

As illustrated in FIG. 10, the voltage applied between a source potential VDD and the reference cathode potential Vcathode(i) is fixed. In contrast, the cathode potential control section 11 variably controls the common cathode potential Vcathode(p) applied to the common cathode electrode according to the measured drive temperature.

As a result, the ratio between two voltages, namely, a voltage applied to the organic EL panel 3 (=VDD−Vcathode (p)) and another applied to the cathode potential application section 23 (=Vcathode(p)−Vcathode(i)), changes according to the drive temperature (measured temperature) of the organic EL panel 3.

It should be noted that the voltage applied between the anode electrode of the organic EL element D and the source potential VDD is maintained almost at a constant level thanks to the variable control of the common cathode potential.

Therefore, the drive current Ids supplied from the current-driving transistor T2 remains unaffected by the change in the drive temperature of the organic EL panel 3. As a result, the current-driving transistor T2 constantly supplies the drive current Ids at the same level so long as the pixel data is the same.

It should be noted that the ratio in power consumption between the organic EL panel 3 and cathode potential application section 23 changes with the change of the ratio between the voltages applied to the respective sections.

This means that the higher the drive temperature, the more the power consumption of the organic EL panel 3 can be reduced by increasing the common cathode potential Vcathode(p). This means that a minimum voltage necessary for the light emission control is applied to the organic EL panel 3 and that the rest of the voltage is allocated to the cathode potential application section 23. This keeps the power consumed for purposes other than the light emission control to a minimum.

Figures 11A, 11B, 11C:
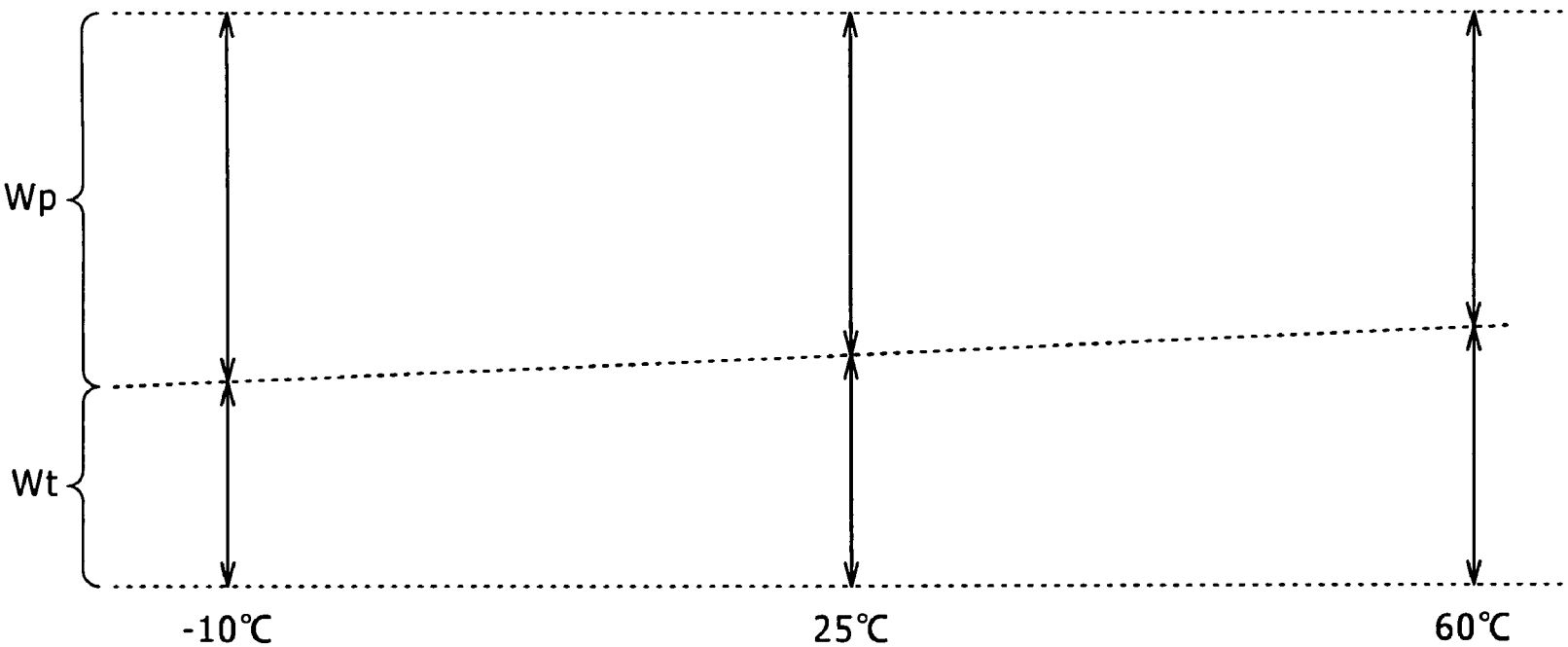
FIGS. 11A to 11C are views describing the variable control of the cathode potential and the change of the panel power consumption.

FIG. 11 illustrates the power consumption allocation ratio according to the drive temperature.

If combined with the heat generation of the panel, the drive temperature of the organic EL panel 3 is typically higher than room temperature. Therefore, the fact that the higher the drive temperature of the organic EL panel 3, the more the power consumption of the same panel 3 can be reduced, which effectively suppresses further heat generation of the same panel 3.

A high drive temperature condition typically acts to shorten the service life of the organic EL element D. Therefore, the reduction in heat generation (power consumption) of the organic EL panel 3 is expected to prolong the light emission life thereof.

However, the voltage between the source potential VDD and reference cathode potential Vcathode(i) is fixed. As a result, if the power consumption of the organic EL panel 3 diminishes, that of the cathode potential application section 23 will increase as much as the reduction in power consumption of the same panel 3. Especially, the power consumption of the filed effect transistor T11 increases.

However, the cathode potential application section 23 is provided externally to the organic EL panel 3. As a result, the drive temperature of the organic EL panel 3 will increase to a lesser extent than when the organic EL panel 3 generates heat.

Further, the heat generating area of the cathode potential application section 23 is extremely small as compared to that of the organic EL panel 3. This ensures ease of heat radiation design. That is, this allows for efficient escape of the heat generated in the cathode potential application section 23, thus keeping the increase in the drive temperature of the organic EL panel 3 at a low level. That is, the temperature dependent characteristic of the organic EL panel 3 can be reduced to a greater extent than by the related art. The larger the area of the effective display region, the more significant the effect thereof.

Still further, the control of the common cathode potential Vcathode(p) performed by the control method described herein affects in no way the driving operation itself of the field effect transistor T11 (that is, the field effect transistor T11 operates in the saturation region). This will not, therefore, reduce the peak brightness level. That is, the display quality will not be impaired.

As described above, the control method according to the present embodiment provides a significant effect not achievable by the related art.

(B) Embodiment 2

A description will be given here of an embodiment of the organic EL panel module in relation to the measurement of the drive temperature by another method. In the present embodiment, a case will be described in which the drive temperature of the organic EL panel 3 is directly measured using dummy pixels having the same structure as those pixels provided in the effective display region.

Figure 12A:
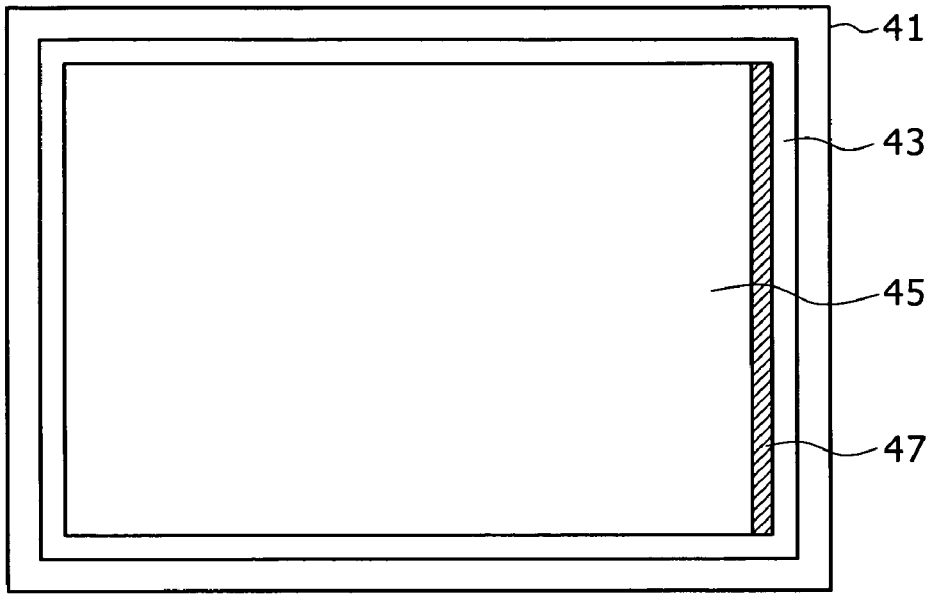
FIGS. 12A and 12B are views describing examples of arrangement of dummy pixels.
Figure 12B:
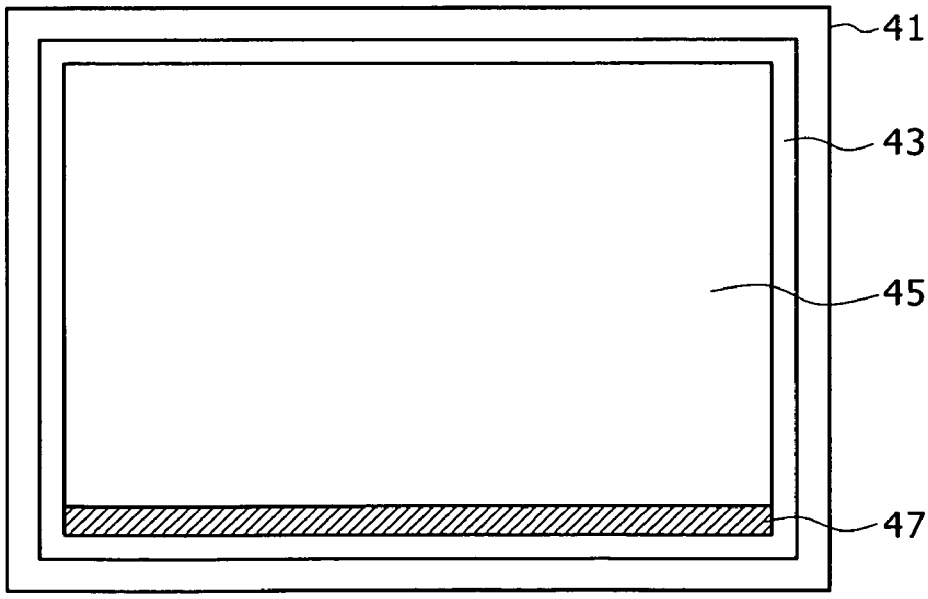

FIGS. 12A and 12B illustrate examples of arrangement of dummy pixels 47 of an organic EL panel 43 making up an organic EL panel module 41. FIG. 12A illustrates an example in which the dummy pixels 47 are arranged on the outer right side of an effective display region 45 of the organic EL panel 43. FIG. 12B illustrates an example in which the dummy pixels 47 are arranged on the outer bottom side of the effective display region 45.

It should be noted that the dummy pixels 47 are structured in the same manner as the pixels 13 making up the effective display region 45. Therefore, the dummy pixels 47 are formed by the same process as the pixels 13 in the effective display region 45.

Figure 13:
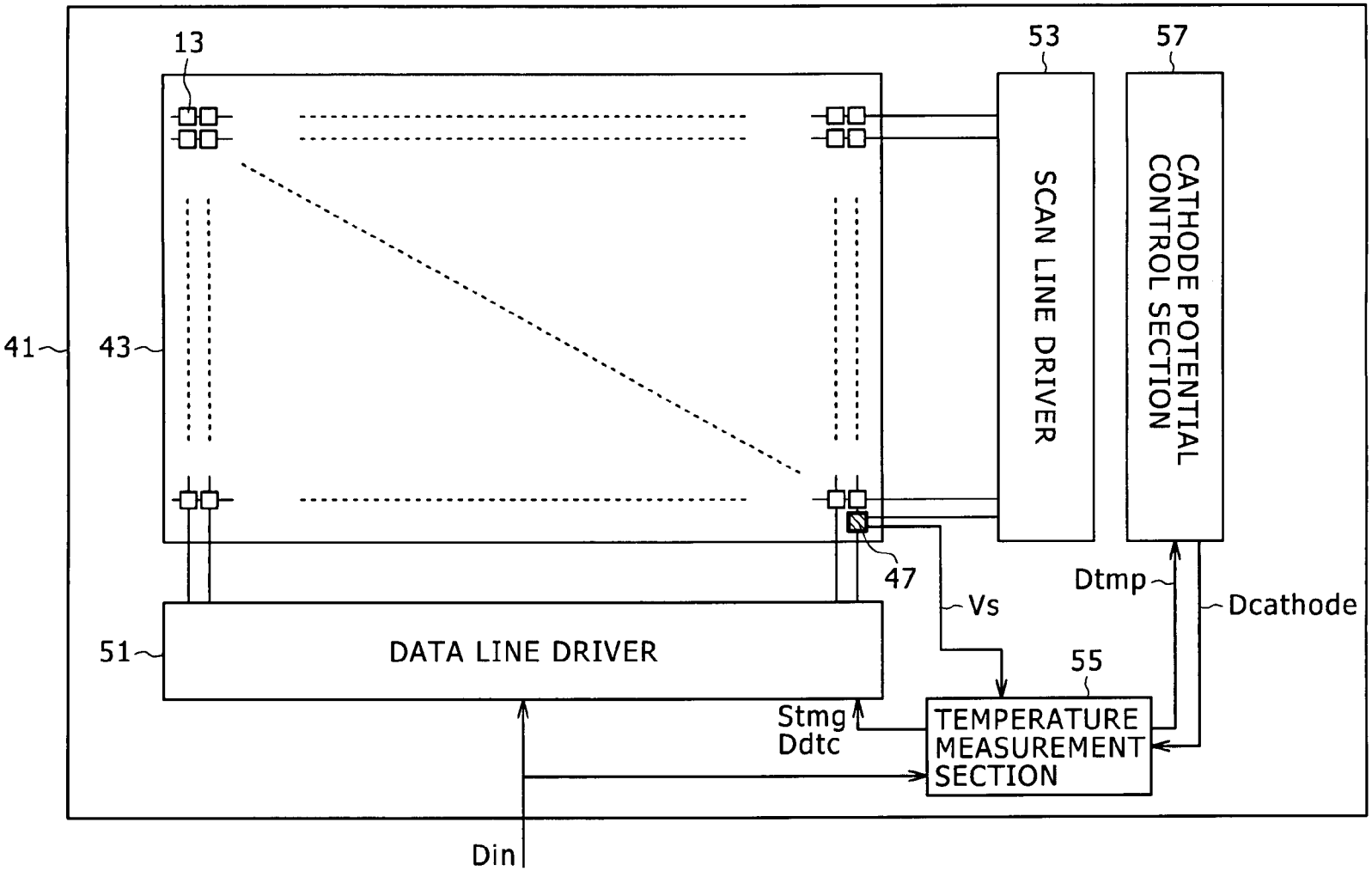
FIG. 13 is a view illustrating a circuit configuration of the organic EL panel module.

FIG. 13 illustrates major components of the organic EL panel module 41. It should be noted that the circuit configuration shown in FIG. 13 is basically the same as in FIG. 1.

The organic EL panel module 41 shown in FIG. 13 includes an organic EL panel 43, data line driver 51, scan line driver 53, temperature measurement section 55 and cathode potential control section 57 as its major components.

The major components shown in FIG. 13 are suitable for the case in which the one dummy pixel 47 is arranged on the outer bottom right side of the effective display region 45. As a result, the data line driver 51 may require a circuit configuration adapted to drive the dummy pixel 47. That is, the same driver 51 has a switch 61. The same switch 61 selectively applies one of two pieces of pixel data, namely, pixel data Din associated with the pixel 13 making up the effective display region 45 and dummy pixel data Ddmy associated with the dummy pixel 47, to the data line DL.

Figure 14:
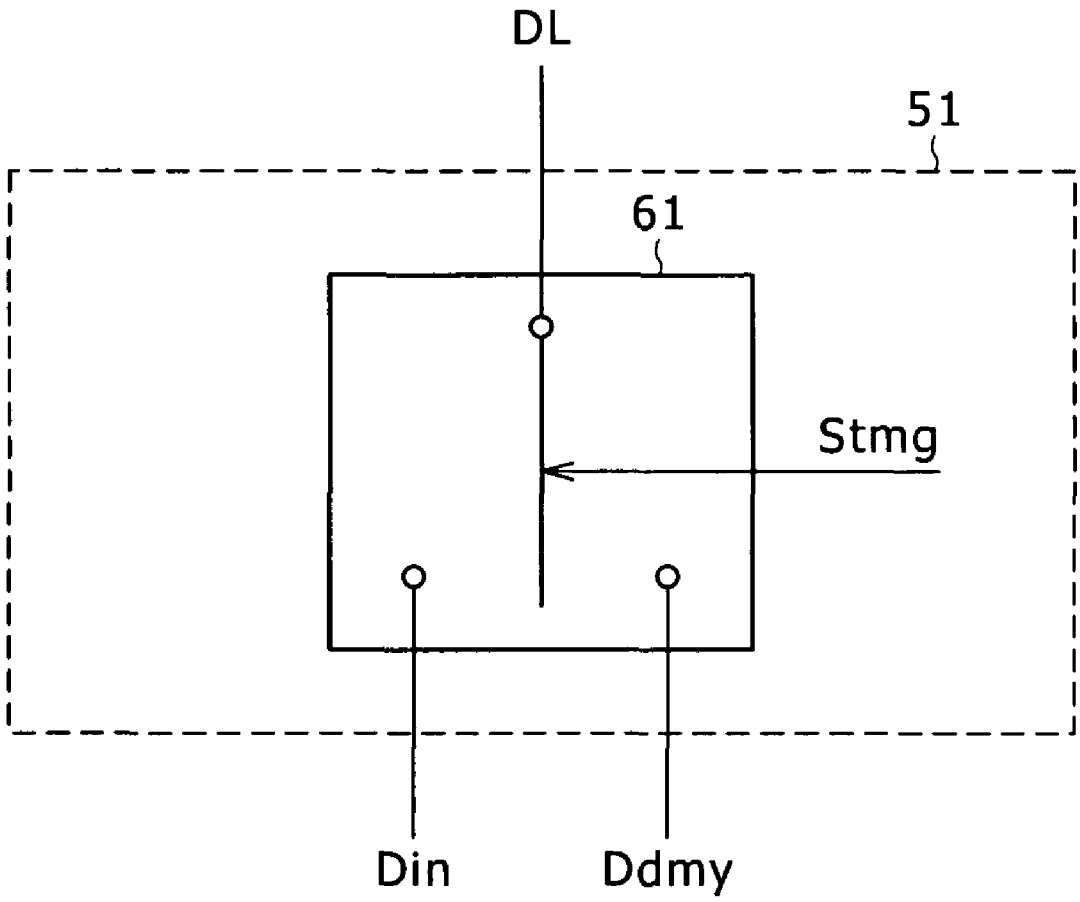
FIG. 14 is a view describing part of the circuit configuration in a data line driver.

FIG. 14 illustrates a configuration example of the switch 61. Naturally, the switch 61 is provided for the data line DL having the dummy pixel 47. Therefore, the switch 61 is connected to none of the other data lines DL.

Figure 15:
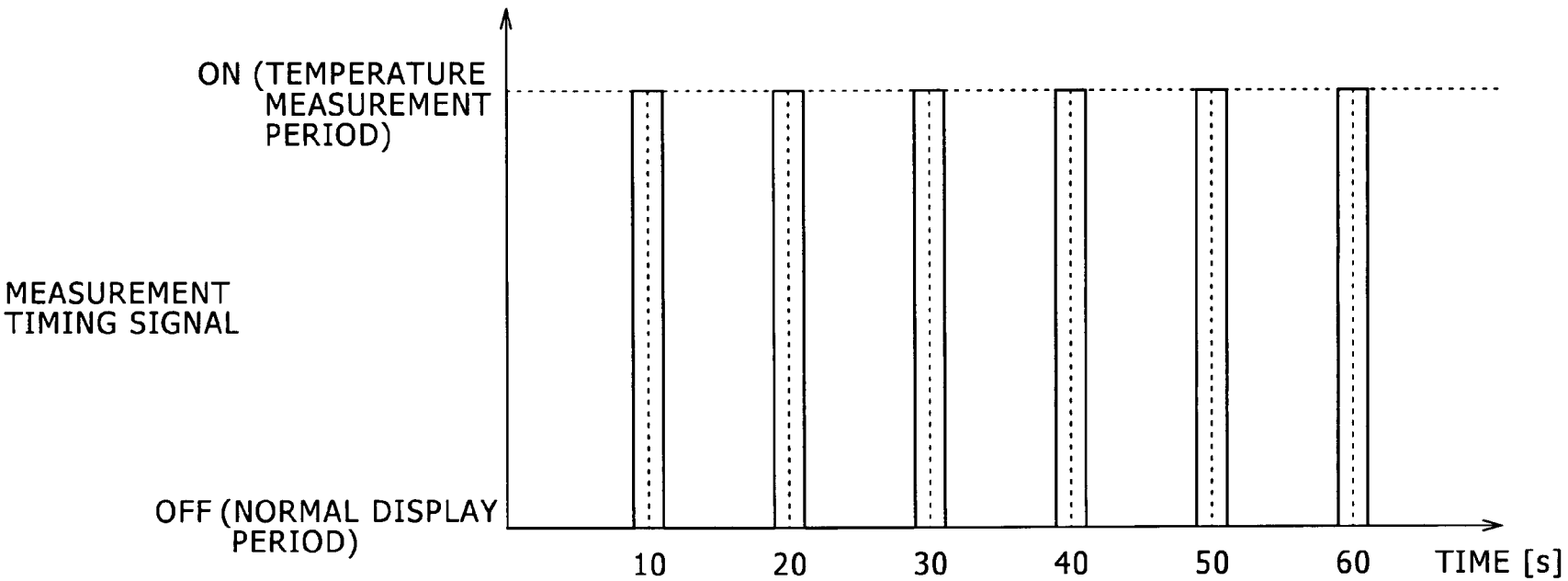
FIG. 15 is a view describing timings at which a measurement timing signal is supplied.

It should be noted that the timing at which to switch the switch 61 is given by the temperature measurement section 55 as a measurement timing signal Stmg. As illustrated in FIG. 15, the measurement timing signal Stmg is output, for example, once every 10 frames.

Further, in the present embodiment, the scan line driver 53 drives and controls the scan line WL dedicated for the dummy pixel 47, thus controlling the writing of the dummy pixel data to the charge holding capacitance C which makes up the dummy pixel 47.

The temperature measurement section 55 is a processing device adapted to detect the drive temperature of the organic EL panel 43 by detecting the anode potential of the organic EL element D making up the dummy pixel 47.

Figure 16:
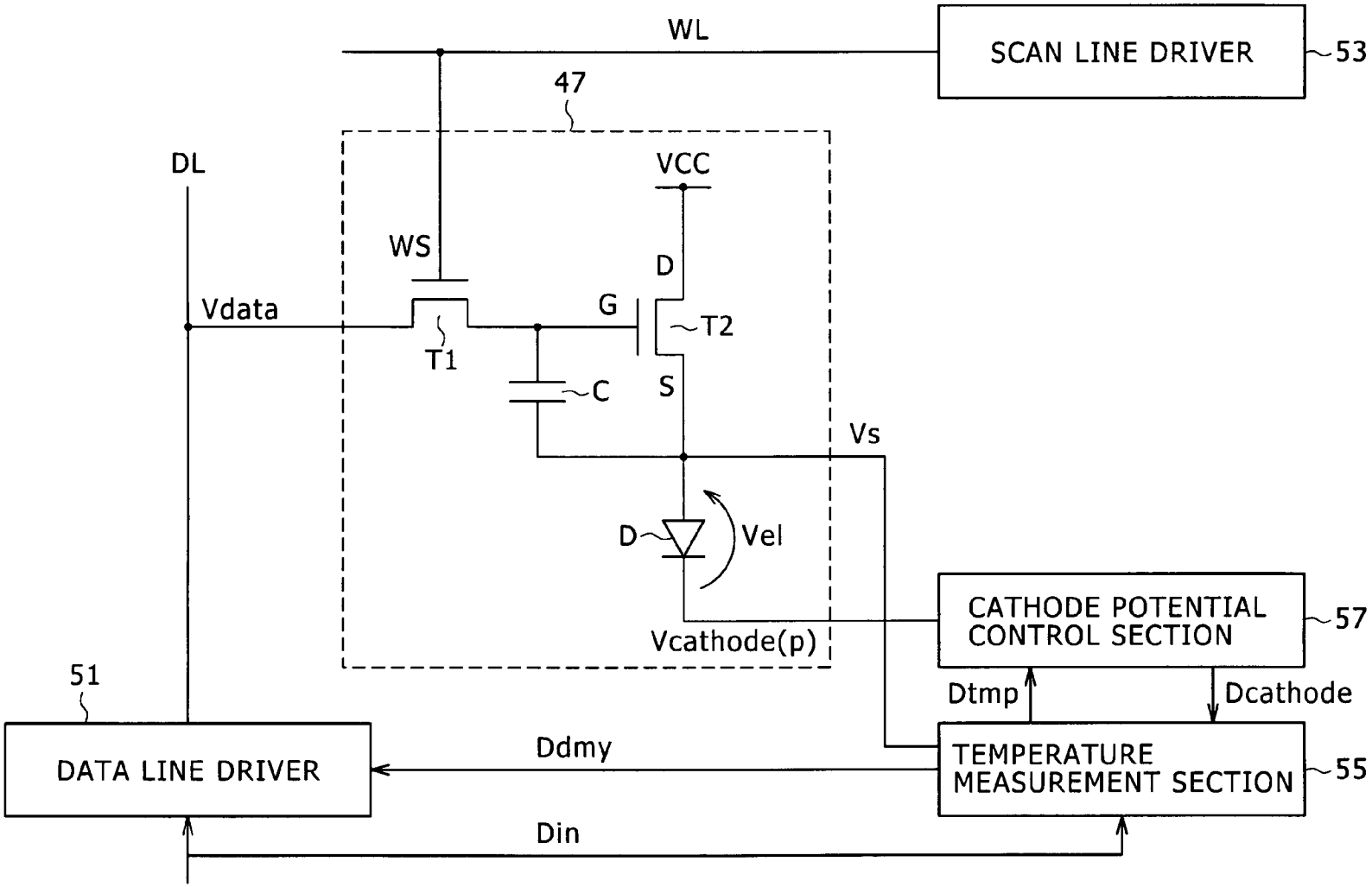
FIG. 16 is a view illustrating the connection between the pixel circuit and peripheral circuitry.
Figure 17:
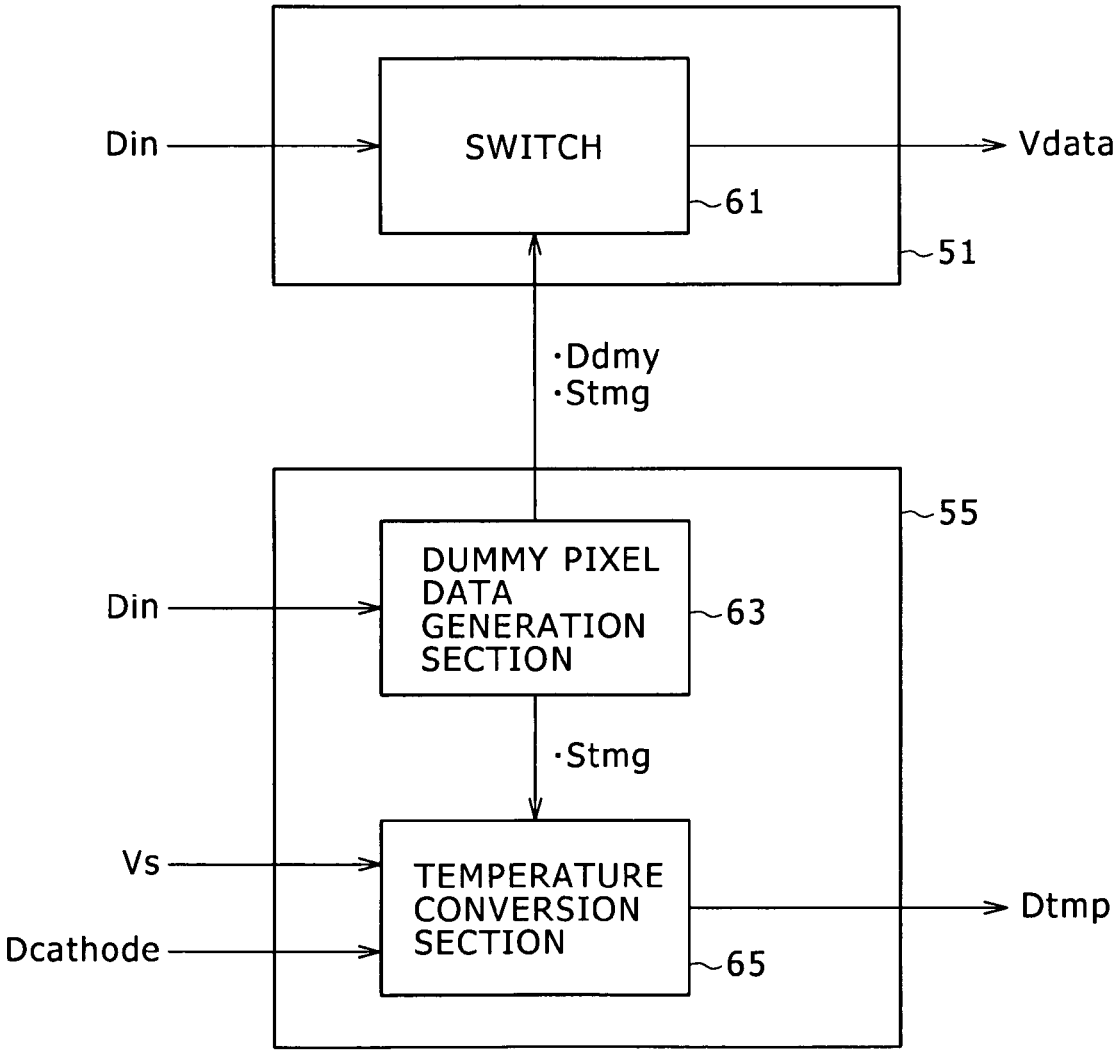
FIG. 17 is a view illustrating an example of internal configuration of a temperature measurement section.

FIG. 16 illustrates the connection between the dummy pixel 47 and temperature measurement section 55. FIG. 17 illustrates an example of internal configuration of the temperature measurement section 55.

As illustrated in FIG. 17, the same section 55 includes a dummy pixel data generation section 63 and temperature conversion section 65.

The dummy pixel data generation section 63 is a processing device adapted to output a frame average of the pixel data Din as the dummy pixel data Ddmy at times other than during detection of the drive temperature and also adapted to output a fixed value for measurement purposes during detection of the drive temperature. Here, the frame average of all pixels making up the effective display region 45 is calculated as the dummy pixel data Ddmy to bring the deterioration status of the dummy pixel 47 or generated heat temperature in agreement with the average over the effective display region.

However, the drive temperature is measured as the voltage Vel which develops between the two electrodes of the organic EL element D when the same voltage (fixed voltage level) is applied. Therefore, the dummy pixel data generation section 63 outputs a fixed value set in advance for measurement purposes during measurement of the drive temperature. It should be noted that the same section 63 outputs, as the measurement timing signal Stmg, a drive temperature measurement timing to the data line driver 51 and temperature conversion section 65.

The temperature conversion section 65 is a signal processing section adapted to measure the temperature of the organic EL panel 43 by measuring the voltage Vel which develops between the two electrodes of the organic EL element D at a measurement timing during the light emission period. Therefore, an anode potential (analog value) Vs and a cathode potential Dcathode of the organic EL element D are given to the temperature conversion section 65.

Figure 18:
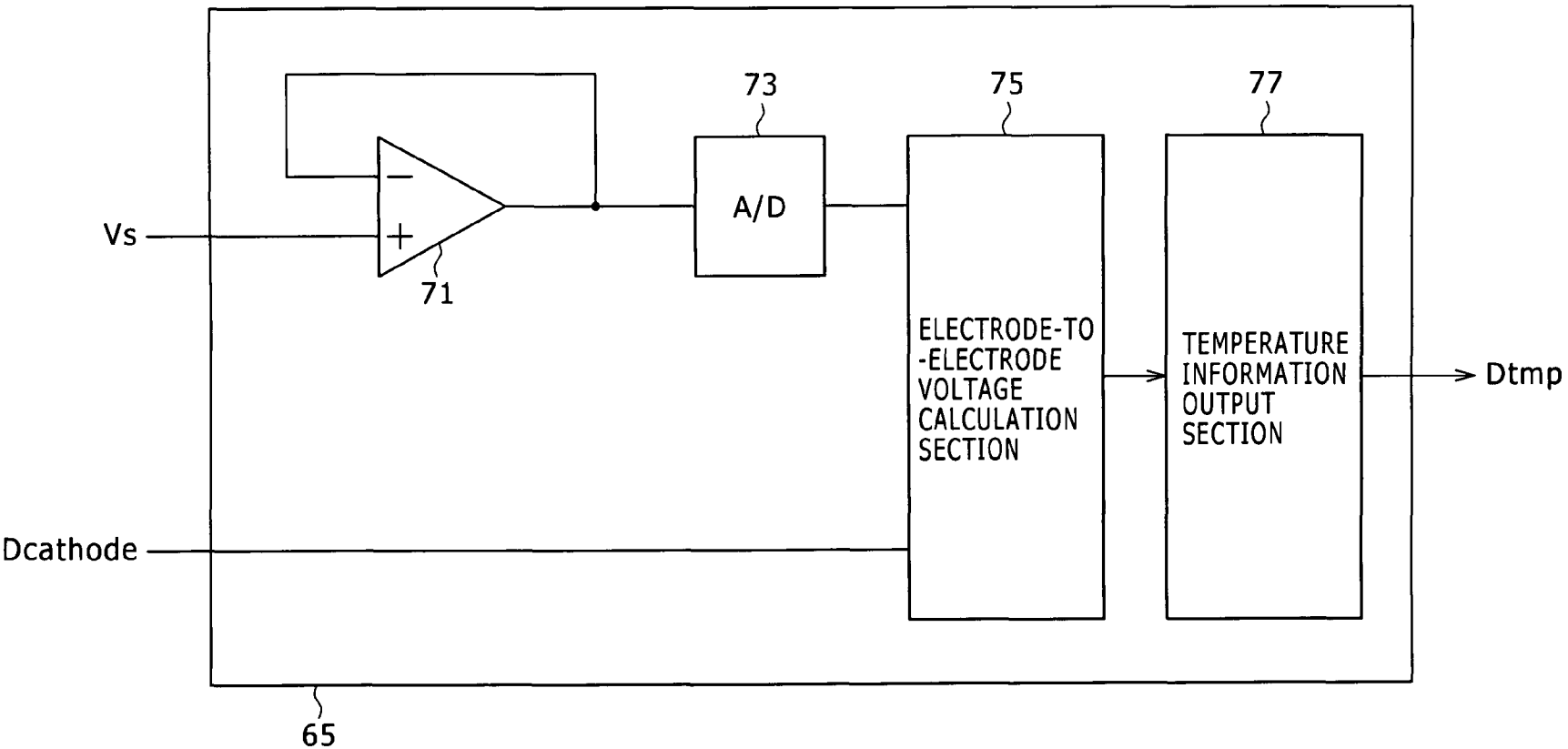
FIG. 18 is a view illustrating an example of internal configuration of a temperature conversion section.

FIG. 18 illustrates an example of internal configuration of the temperature conversion section 65. In the present embodiment, the same section 65 includes a voltage follower circuit 71 adapted to measure the anode potential Vs, analog-digital conversion circuit (A/D conversion circuit) 73, electrode-to-electrode voltage calculation section 75 and temperature information output section 77.

Here, the anode voltage Vs is measured by the voltage follower circuit 71 because the magnitude of the drive current supplied to the organic EL element D is extremely small or of the order of nanoamperes. That is, it is extremely difficult to directly measure the change of the electrode-to-electrode voltage Vel from the drive current.

It should be noted that the anode potential Vs detected via the voltage follower circuit 71 is in analog form. Therefore, the anode potential Vs is converted into a digital form by the analog-digital conversion circuit 73.

The electrode-to-electrode voltage calculation section 75 calculates the difference in voltage between the anode potential Vs, which develops on the anode electrode of the organic EL element D, and the common cathode potential Vcathode (p) applied to the cathode electrode of the same element D. Practically, the same section 75 calculates the difference between the two digital values.

This arithmetic process calculates the voltage which develops between the two electrodes of the organic EL element D. Such an arithmetic process is performed because, in the present embodiment, the dummy pixels 47 have the same circuit configuration as the pixels 13 in the effective display region 45. That is, the arithmetic process is performed because the common cathode potential Vcathode(p) of the organic EL element D is variably controlled. This is the reason why the difference in potential is calculated between the two electrodes of the organic EL element D.

The temperature information output section 77 is a circuit device adapted to read a temperature Dtmp, associated with the calculated potential difference, from the correspondence table and output the read temperature.

FIG. 19 illustrates an example of a correspondence table. This correspondence table stores the voltage Vel developing between the two electrodes of the organic EL element D and the drive temperature in association with each other when the same element D is controlled to emit light using the dummy pixel data for purposes of temperature measurement.

As illustrated in FIG. 19, low drive temperatures Stmp are associated with the high voltage levels Vel, and high drive temperatures Stmp with the low voltage levels Vel. In the case of FIG. 19, "9.3 V" is associated with "−10° C.", and "7 V" with "60° C."

The temperature conversion section 65 supplies the temperature Dtmp, read by referring to the correspondence table, to the cathode potential control section 57.

Figure 20:
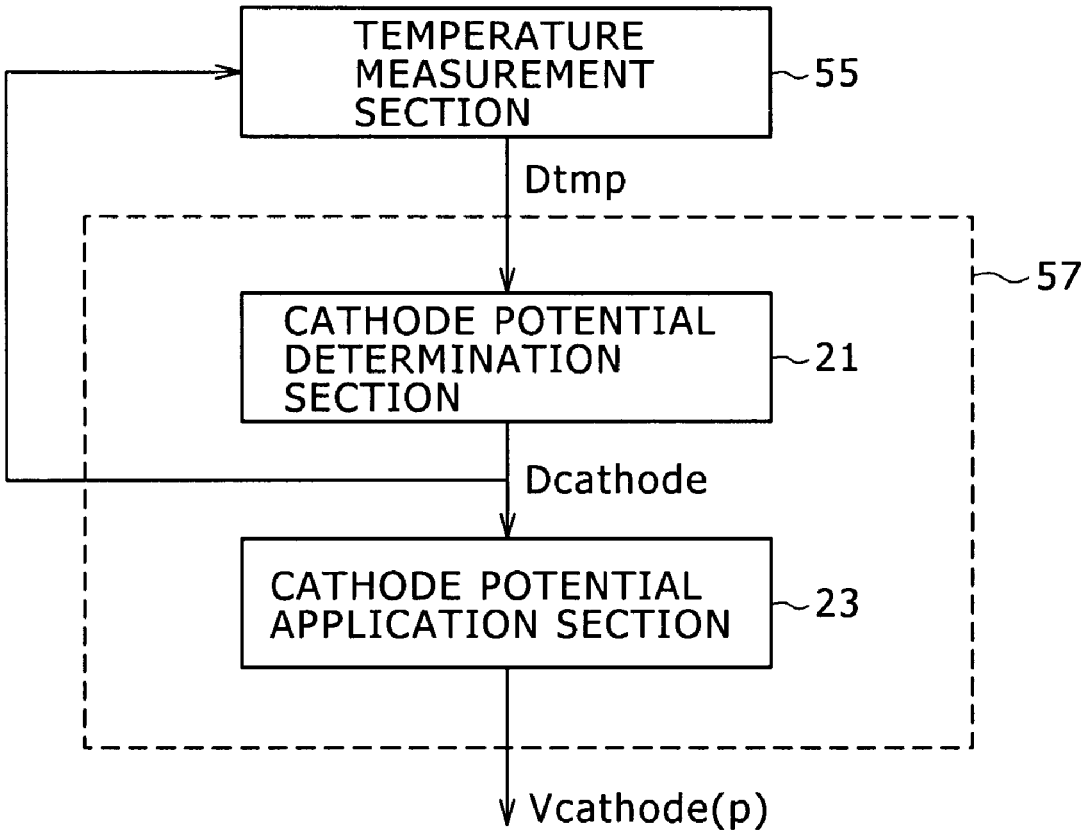
FIG. 20 is a view illustrating an example of internal configuration of the cathode potential control section.

The cathode potential control section 57 is basically configured in the same manner as in Embodiment 1. It should be noted, however, that the connection between the cathode potential control section 57 and other devices differs slightly. For this reason, FIG. 20 illustrates the connection therebetween. In the present embodiment, the drive temperature Dtmp is given by the temperature measurement section 55, and the determined cathode potential Dcathode is output to the temperature measurement section 55.

It should be noted that the operation following the detection of the drive temperature Dtmp is the same as in Embodiment 1. A description thereof will, therefore, be omitted.

As in the present embodiment, directly measuring the drive temperature of the dummy pixels 47 having the same structure as the pixels 13 of the effective display region 45 provides higher accuracy than measuring the drive temperature of the organic EL panel 43 with a temperature sensor. This contributes to improved accuracy in controlling the common cathode potential Vcathode(p).

(C) Embodiment 3

A case was described in relation to Embodiment 2 in which the dummy pixels 47 for purposes of temperature measurement were arranged on the organic EL panel 43.

However, the drive temperature of the same panel 43 may be measured using the pixels provided within the effective display region 45.

Figure 21A:
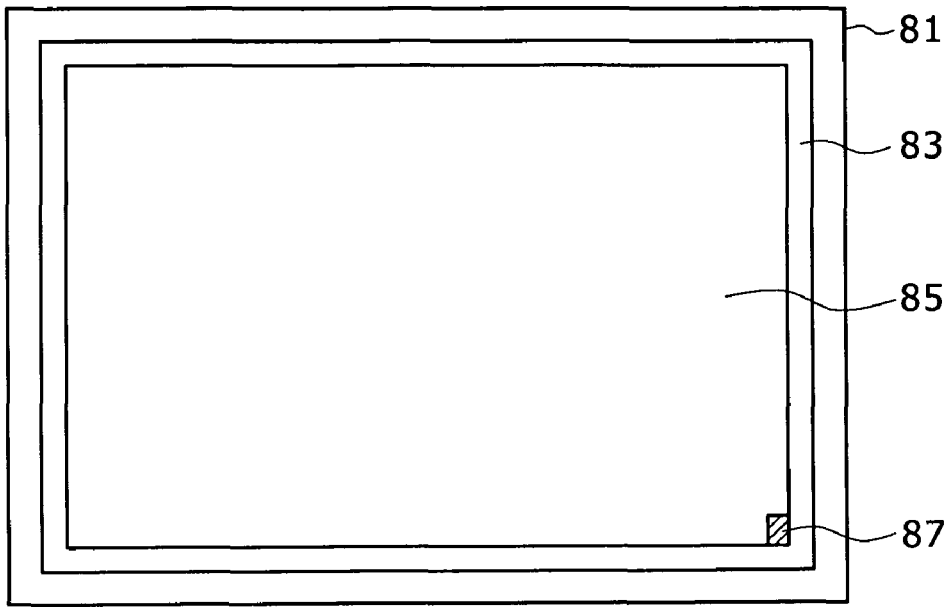
FIGS. 21A and 21B are views describing examples of arrangement of a dual-purpose pixel.
Figure 21B:
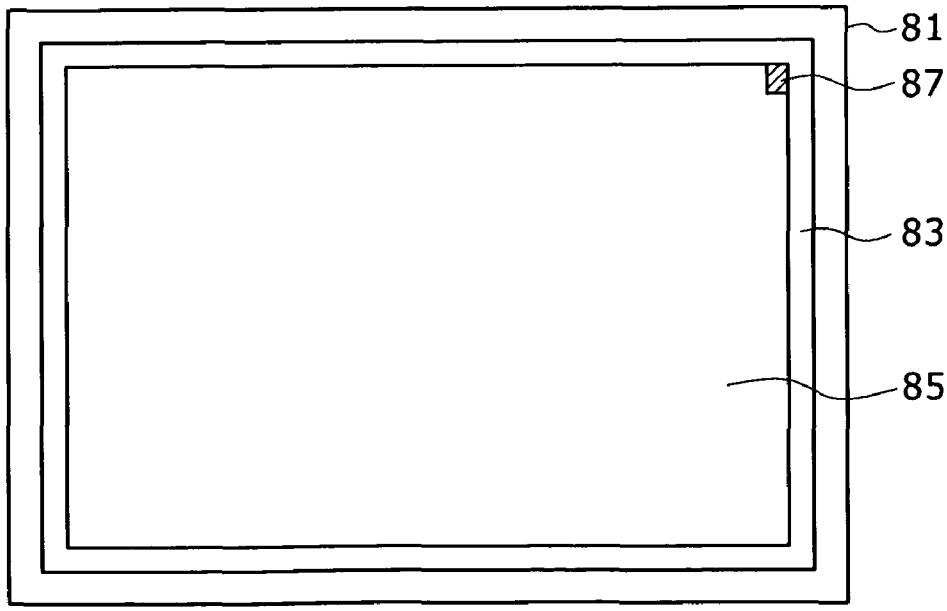

FIGS. 21A and 21B illustrate examples of arrangement of a dummy pixel 87 of an organic EL panel 83 making up an organic EL panel module 81. FIG. 21A illustrates a case in which the pixel 87 serving two purposes of screen display and temperature measurement (hereinafter referred to as the "dual-purpose pixel") is arranged at the bottom right corner of an effective display region 85. FIG. 21B illustrates a case in which the dual-purpose pixel 87 is arranged at the top right corner of the effective display region 85.

Naturally, as many of the dual-purpose pixels 87 as desired may be provided, and they may be arranged in any desired position. However, in terms of possible impact on the display quality and panel design, the dual-purpose pixel 87 is preferably arranged somewhere on the outer periphery of the effective display region 85.

It should be noted that the dual-purpose pixel 87 is structured in the same manner as the other pixels in the effective display region 85 except that a lead wiring is additionally formed to measure the anode potential of the organic EL element D. Therefore, the dual-purpose pixel 87 is formed integrally with the effective display region 85 by the same process.

Incidentally, the basic circuit configuration necessary to drive the dual-purpose pixel 87 may be the same as in Embodiment 2. However, the same pixel 87 has to display a normal image at times other than during temperature measurement. Therefore, there is no need to output a frame average of the pixel data as the dummy pixel data as in Embodiment 2.

Figure 22:
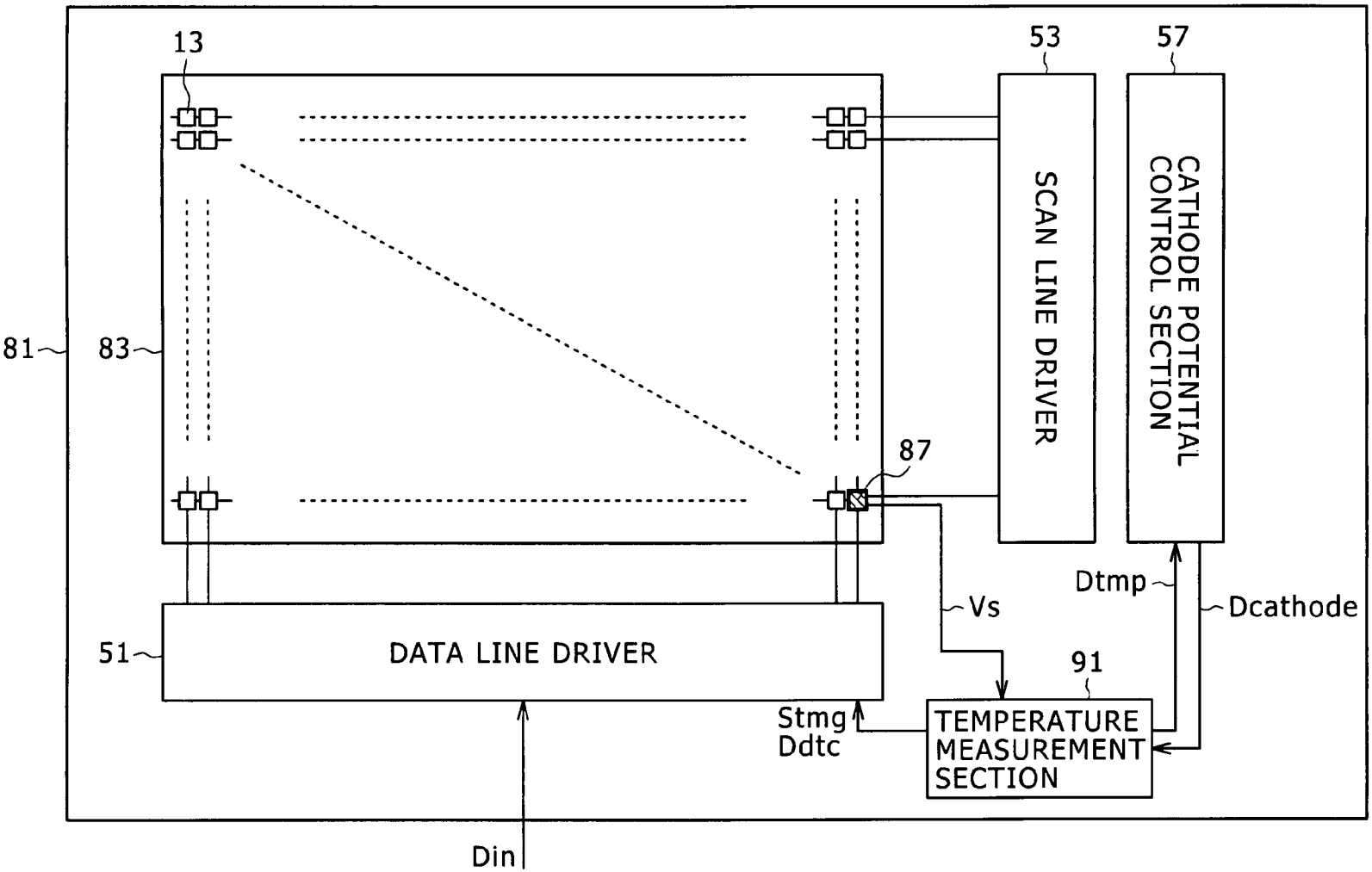
FIG. 22 is a view illustrating a circuit configuration of the organic EL panel module.

FIG. 22 illustrates major components of the organic EL panel module 81. It should be noted that in FIG. 22 like components as those in FIG. 13 are denoted by the same reference numerals. As illustrated in FIG. 22, the organic EL panel module 81 includes the organic EL panel 83, data line driver 51, scan line driver 53, a temperature measurement section 91 and the cathode potential control section 57 as its major components.

Figure 23:
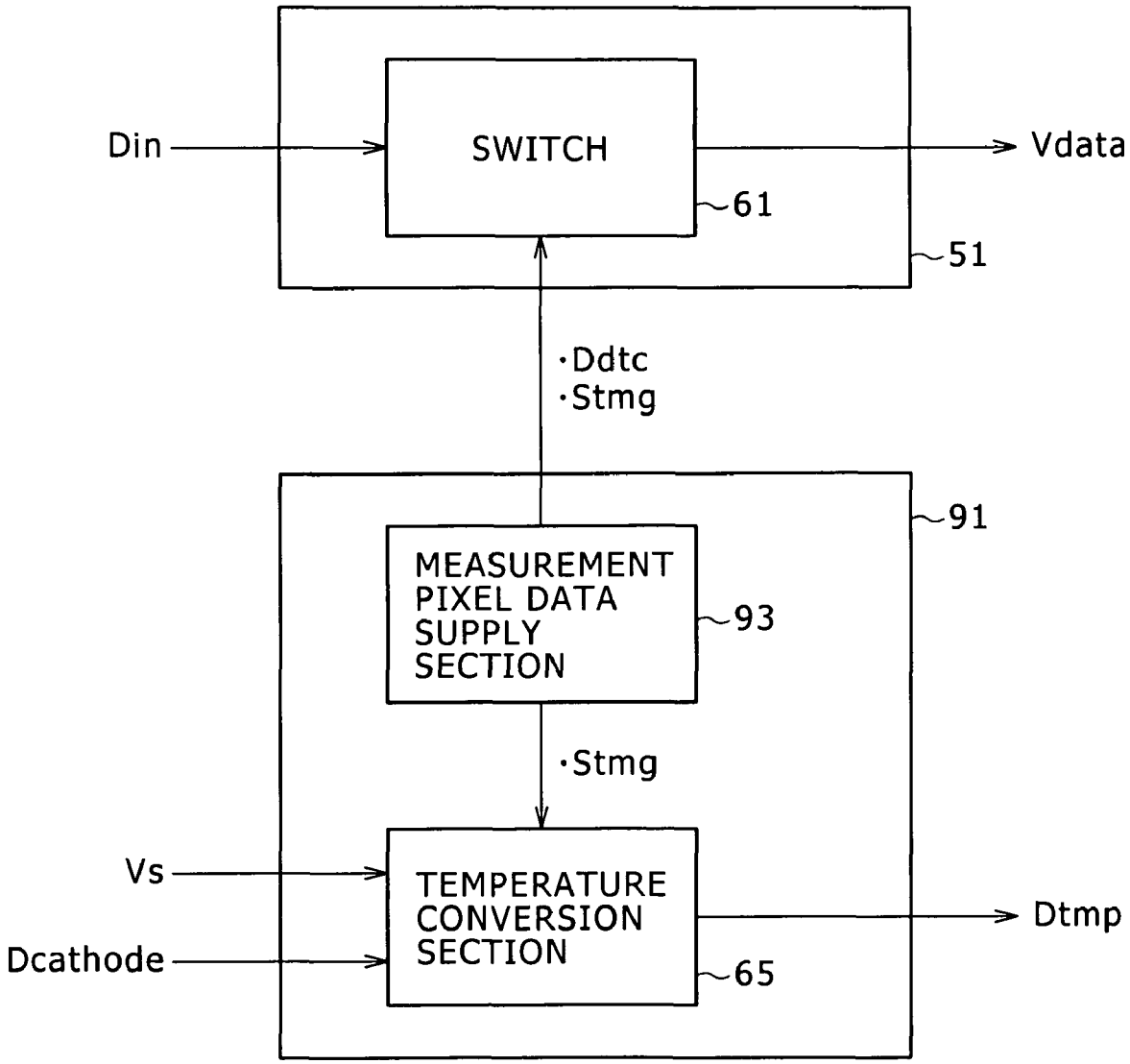
FIG. 23 is a view illustrating an example of internal configuration of the temperature measurement section.

FIG. 23 illustrates an example of internal configuration of the temperature measurement section 91. In FIG. 23, like components as those in FIG. 17 are denoted by the same reference numerals. The temperature measurement section 91 includes a measurement pixel data supply section 93 and the temperature conversion section 65. The measurement pixel data supply section 93 is a processing device adapted to output a fixed value for measurement purposes as measurement pixel data Ddtc during measurement of the drive temperature. Incidentally, the dual-purpose pixel 87 is driven and controlled by the type of image displayed at the position concerned at times other than during measurement of the drive temperature.

Except for those positions where a still image such as time is primarily displayed, the heat generating status and characteristic deterioration of the organic EL element D do not differ significantly from the average of all pixels in the display region adapted to display a moving image. Therefore, measuring the drive temperature of the dual-purpose pixel 87 at regular or irregular intervals allows for measurement of the drive temperature of the organic EL panel 83.

(D) Other Embodiments (D-1) Other Example of Measuring the Drive Temperature

A case was described in relation to Embodiment 1 in which the surface temperature of the organic EL panel 3 measured with a temperature sensor was used as the drive temperature thereof. Further, a case was described in relation to Embodiments 2 and 3 in which the temperature measured based on the voltage Vel developing between the two electrodes of the organic EL element D was used as the drive temperature thereof.

However, the ambient temperature (atmospheric temperature) detected by a temperature sensor provided around the organic EL panel may be used as the drive temperature. Further, temperature information measured by a temperature sensor contained in other electronic equipment and transmitted by means of a communication function may be used as the drive temperature.

Still further, to measure the temperature in Embodiment 2 or 3, a plurality of pixels to be measured (dummy pixels or dual-purpose pixels) may be used. In particular, if the temperature distribution is not uniform across the display panel surface, it is preferred to detect the temperature using a plurality of pixels arranged in a dispersed manner. For example, the minimum drive temperature is used.

In this case, the operation of the current-driving transistor T2 in the saturation region can be ensured for all pixels. However, if the same transistor T2 is permitted to operate in the linear region close to the saturation region, the average of the temperatures measured on a plurality of pixels may be used for a certain number of pixels.

(D-2) Product Examples (a) Drive IC

In the above description, an organic EL panel module was described in which a pixel array section (organic EL panel) and drive circuits (e.g., data line driver, scan line driver and cathode potential control section) were formed on a single base body.

However, the pixel array section may be manufactured separately from the drive circuits and other components so that each can be circulated as an independent product. For example, the drive circuits may each be manufactured in the form of an independent drive IC (integrated circuit) so that they can be circulated separately from the pixel array section.

(b) Display Module

Figure 24:
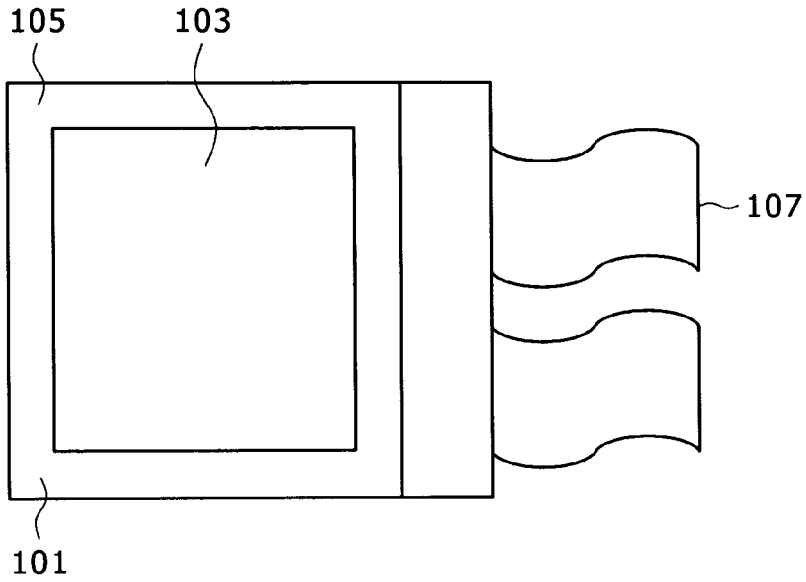
FIG. 24 is a view illustrating an example of internal configuration of a display module.

The organic EL panel module according to the above embodiments may be circulated in the form of a panel module 101 having an appearance and configuration as shown in FIG. 24.

The panel module 101 has an opposed section 103 affixed to the surface of a support substrate 105.

A transparent member such as glass is used as the base material of the opposed section 103. A color filter, protective film, light-shielding film or other material is applied over the surface thereof.

It should be noted that the panel module 101 may have an FPC (flexible printed circuit) 107 or other component adapted to allow exchange of signals between the support substrate 105 and external equipment.

(C) Electronic Equipment

The organic EL panel module in the above embodiments may be circulated in the form of a product contained in electronic equipment.

Figure 25:
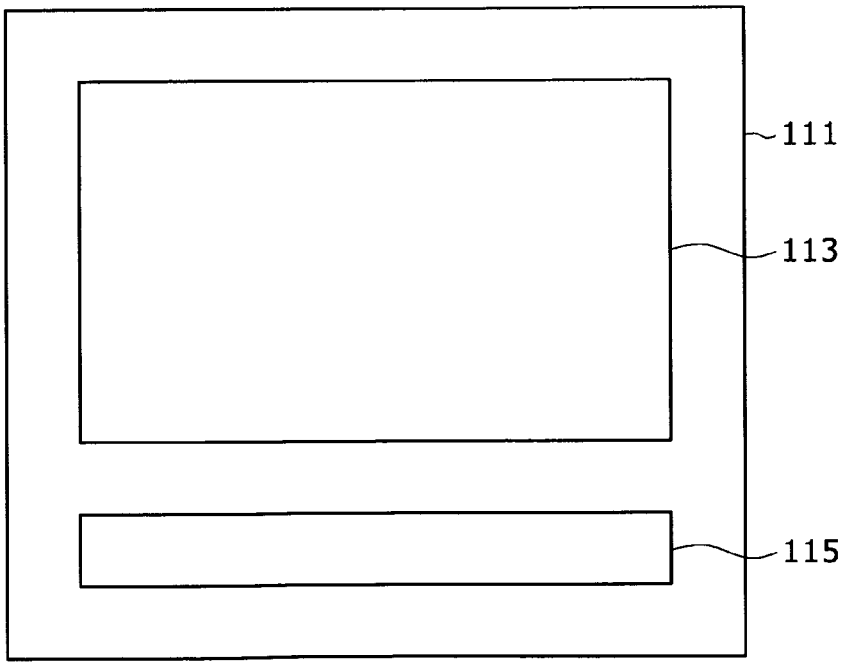
FIG. 25 is a view illustrating an example of functional configuration of electronic equipment.

FIG. 25 illustrates an example of conceptual configuration of electronic equipment 111. The electronic equipment 111 includes an organic EL panel module 113 described earlier and system control section 115. The processes performed by the system control section 115 vary depending on the product type of the electronic equipment 111.

It should be noted that the electronic equipment 111 is not limited to any specific field so long as it has the function to display images and video produced within the equipment or supplied from external equipment.

Figure 26:
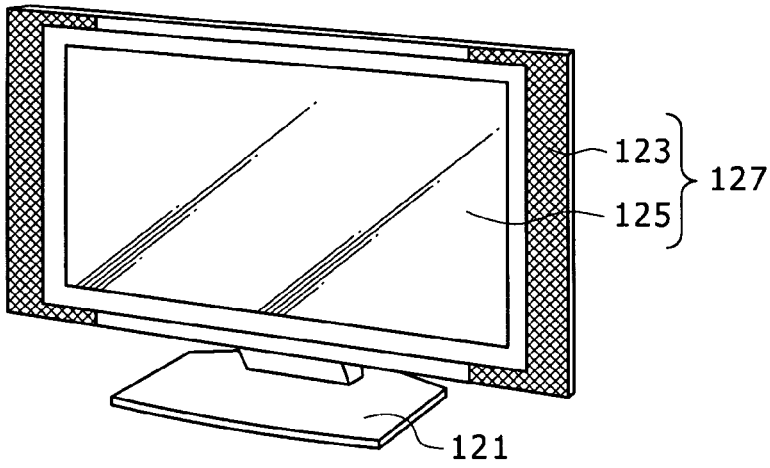
FIG. 26 is a view illustrating an example of an electronic equipment product.

A television set is one among possible examples of the electronic equipment 111 of this type. FIG. 26 illustrates an example of appearance of a television set 121.

A display screen 127, which includes, for example, a front panel 123 and filter glass 125, is provided on the front of the enclosure of the television set 121. The display screen 127 corresponds to the organic EL panel module described in the above embodiments.

Figure 27A:
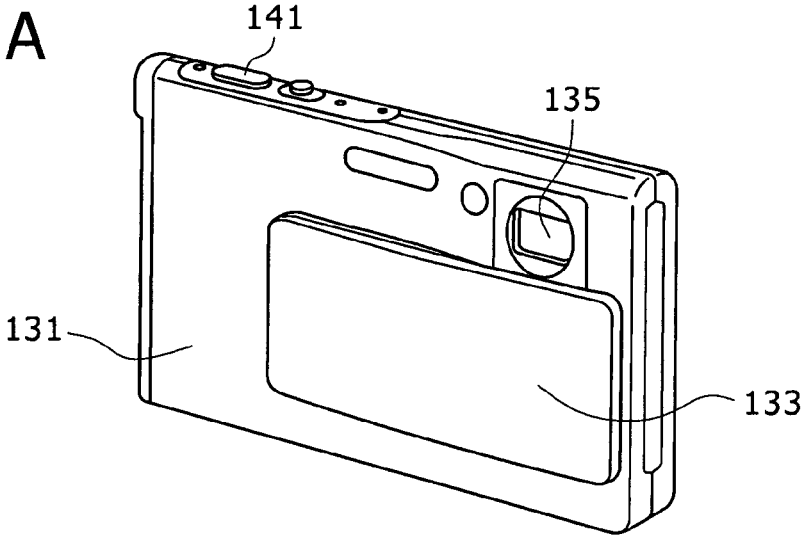
FIGS. 27A and 27B are views illustrating an example of an electronic equipment product.
Figure 27B:
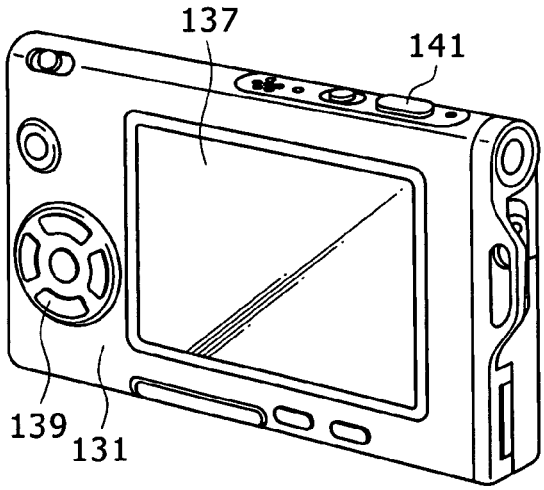

A digital camera is another possible example of the electronic equipment 111 of this type. FIGS. 27A and 27B illustrate an example of appearance of a digital camera 131. FIG. 27A illustrates an example of appearance seen from the front (subject). FIG. 27B illustrates an example of appearance seen from the rear (photo shooter).

The digital camera 131 includes a protective cover 133, imaging lens section 135, display screen 137, control switches 139 and shutter button 141. Of these components, the display screen 137 corresponds to the organic EL panel module described in the above embodiments.

Figure 28:
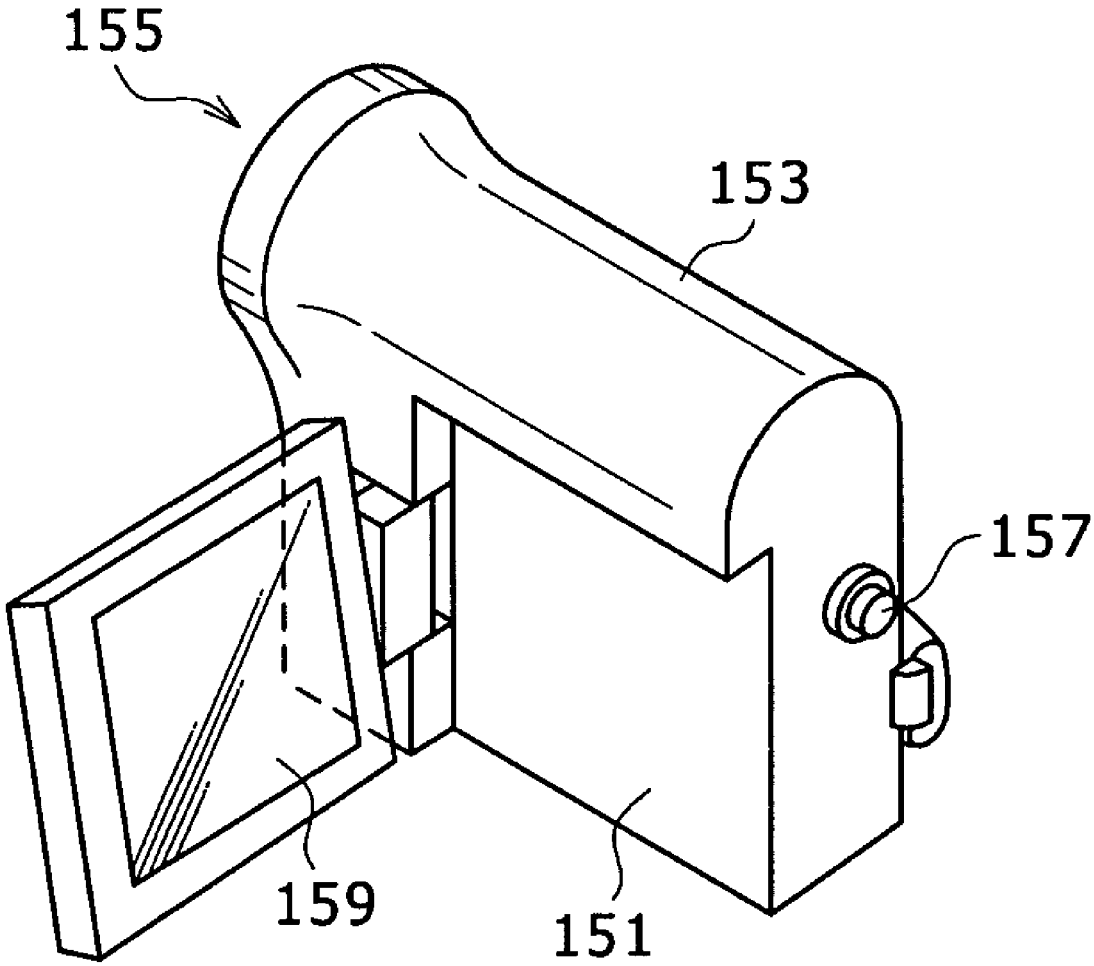
FIG. 28 is a view illustrating an example of an electronic equipment product.

A video camcorder is yet another possible example of the electronic equipment 111 of this type. FIG. 28 illustrates an example of appearance of a video camcorder 151.

The video camcorder 151 includes an imaging lens 155 provided on the front of a main body 153, shooting start/stop switch 157 and display screen 159. Of these components, the display screen 159 corresponds to the organic EL panel module described in the above embodiments.

Figure 29A:
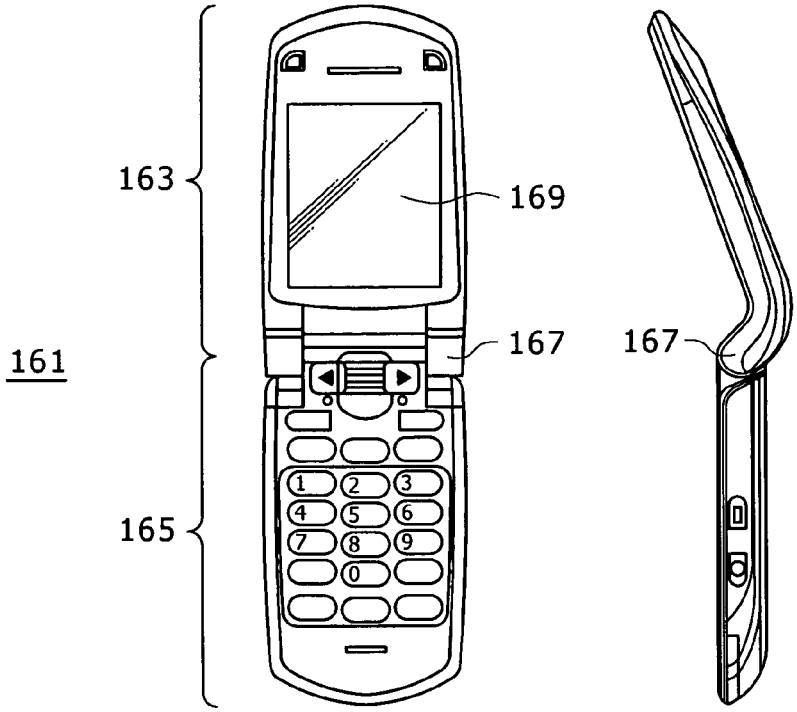
FIGS. 29A and 29B are views illustrating an example of an electronic equipment product.
Figure 29B:
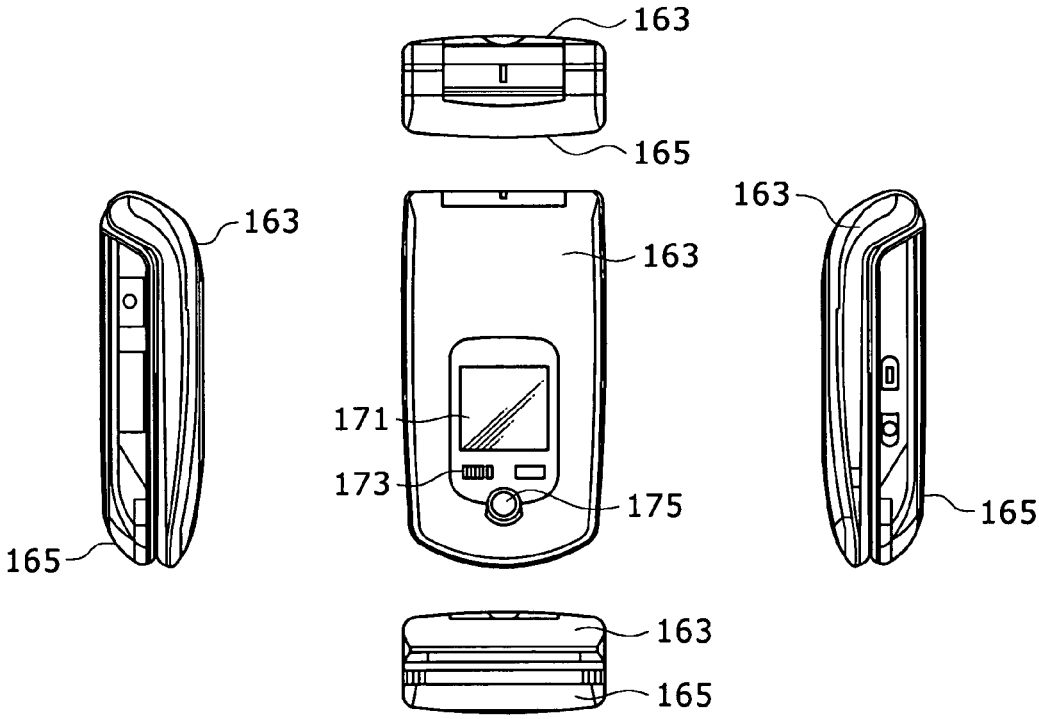

A portable terminal device is yet another possible example of the electronic equipment 111 of this type. FIGS. 29A and 29B illustrate an example of appearance of a mobile phone 161 as a portable terminal device. The mobile phone 161 shown in FIGS. 29A and 29B is foldable. FIG. 29A illustrates an example of appearance thereof with its enclosure unfolded. FIG. 29B illustrates an example of appearance thereof with its enclosure folded.

The mobile phone 161 includes an upper enclosure 163, lower enclosure 165, connecting section (hinge section in this example) 167, display screen 169, auxiliary display section 171, picture light 173 and imaging lens 175. Of these components, the display screen 169 and auxiliary display section 171 correspond to the organic EL panel module described in the above embodiments.

Figure 30:
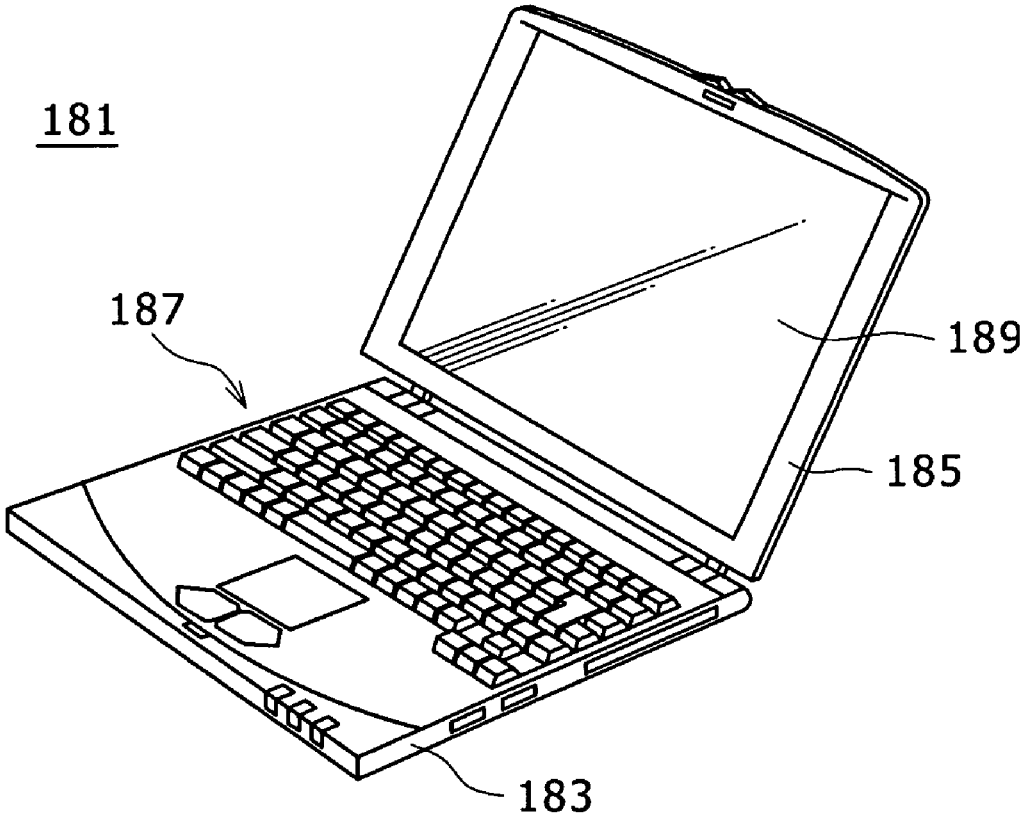
FIG. 30 is a view illustrating an example of an electronic equipment product.

A computer is yet another possible example of the electronic equipment 111 of this type. FIG. 30 illustrates an example of appearance of a laptop computer 181.

The laptop computer 181 includes a lower enclosure 183, upper enclosure 185, keyboard 187 and display screen 189. Of these components, the display screen 189 corresponds to the organic EL panel module described in the above embodiments.

Among other possible examples of the electronic equipment 111 are audio player, gaming machine, electronic book and electronic dictionary.

(D-3) Other Example of Pixel Circuit

The cases were described in relation to the above embodiments in which an N-channel field effect transistor was used as the current-driving transistor T2.

However, the present invention is also applicable when the current-driving transistor T2 includes a P-channel field effect transistor.

Figure 31:
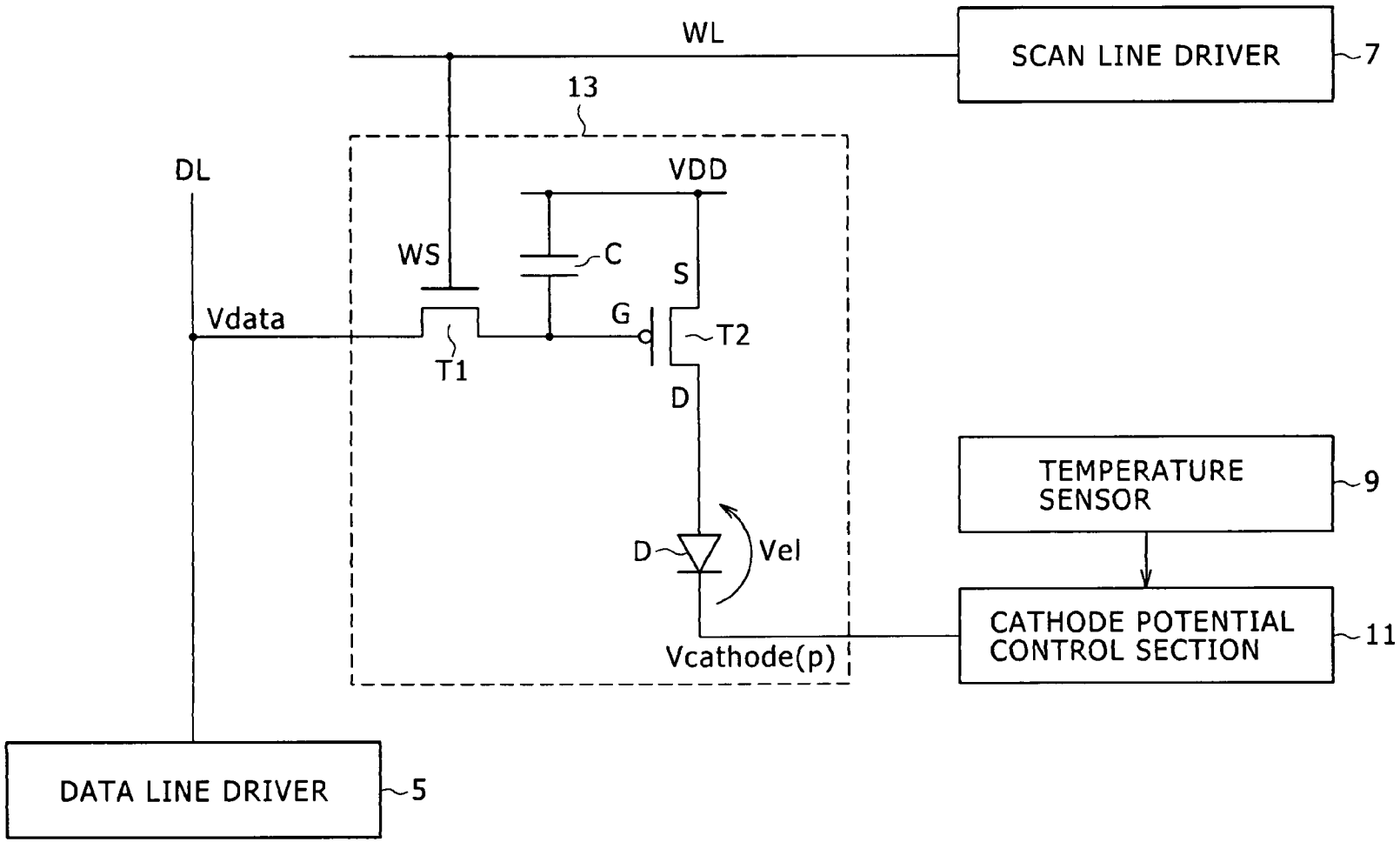
FIG. 31 is a view illustrating another example of a pixel circuit.

FIG. 31 illustrates an example of circuit configuration when a P-channel field effect transistor is used as the current-driving transistor T2. It should be noted that in FIG. 31 like components as those in FIG. 2 are denoted by the same reference numerals.

In the case of this pixel circuit, the charge holding capacitance C is connected to hold the voltage Vdata which corresponds to the pixel data between the source potential VDD and gate electrode of the current-driving transistor T2.

(D-4) Other Example of Display Device

The cases were described in relation to the above embodiments in which the common cathode potential of the organic EL panel module was controlled.

However, the cathode potential control function is also applicable to other types of self-luminous display devices. For example, this function is applicable to an inorganic EL display device, display device with LEDs and other display device with light-emitting elements having a diode structure arranged on the screen.

(D-5) Control Device Configuration

In the above description, the cases were described in which the cathode potential control function was implemented by hardware.

However, part of the cathode potential control function may be implemented by software.

(D-6) Others

The above embodiments may be modified in various manners without departing from the spirit of the present invention. Also, various modifications and applications may be made by creation or combination based on the disclosure of the present invention described herein.

It should be understood by those skilled in the art that various modifications, combinations, sub-combinations and alterations may occur depending on design requirements and other factors insofar as they are within the scope of the appended claims or the equivalents thereof.

What is claimed is:

1. A cathode potential control device for controlling a common cathode potential applied to a self-luminous display panel adapted to drive and control the light emission status of each of the pixels by active matrix driving, the cathode potential control device comprising:

a cathode potential determination section adapted to read a cathode potential level from a table memory according to a current panel temperature, the cathode potential level being associated with a panel temperature so as to cancel the temperature dependent characteristic of a voltage which develops between anode and cathode electrodes of a self-luminous element during light emission, the cathode potential level causing a drive transistor of the self-luminous element to operate in the saturation region; and a cathode potential application section adapted to develop a cathode potential associated with the determined cathode potential level and supply the potential to a common cathode electrode of the self-luminous display panel.

2. The cathode potential control device of claim 1, wherein the current panel temperature is given as a temperature measured by a temperature sensor provided close to an effective display region.

3. The cathode potential control device of claim 1, wherein the current panel temperature is given as a temperature measured by a temperature sensor adapted to detect an ambient temperature.

4. The cathode potential control device of claim 1, wherein when dummy pixels arranged on a display panel for purposes of temperature measurement are driven and controlled by pixel data for purposes of temperature measurement, the current panel temperature is given based on a voltage which develops between anode and cathode electrodes of a self-luminous element.

5. The cathode potential control device of claim 1, wherein when one or a plurality of pixels to be measured making up an effective display region of a display panel are driven and controlled by pixel data for purposes of temperature measurement, the current panel temperature is given based on a voltage which develops between anode and cathode electrodes of a self-luminous element making up the pixel or pixels to be measured.

6. A self-luminous display device comprising:

a self-luminous display panel adapted to drive and control the light emission status of each of the pixels by active matrix driving;

a cathode potential determination section adapted to read a cathode potential level from a table memory according to a current panel temperature, the cathode potential level being associated with a panel temperature so as to cancel the temperature dependent characteristic of a voltage which develops between anode and cathode electrodes of a self-luminous element during light emission, the cathode potential level causing a drive transistor of the self-luminous element to operate in the saturation region; and a cathode potential application section adapted to develop a cathode potential associated with the determined cathode potential level and supply the potential to a common cathode electrode of the self-luminous display panel.

7. An electronic equipment comprising:

a self-luminous display panel adapted to drive and control the light emission status of each of the pixels by active matrix driving;

a cathode potential determination section adapted to read a cathode potential level from a table memory according to a current panel temperature, the cathode potential level being associated with a panel temperature so as to cancel the temperature dependent characteristic of a voltage which develops between anode and cathode electrodes of a self-luminous element during light emission, the cathode potential level causing a drive transistor of the self-luminous element to operate in the saturation region;

a cathode potential application section adapted to develop a cathode potential associated with the determined cathode potential level and supply the potential to a common cathode electrode of the self-luminous display panel;

a system control section; and an operational input section for the system control section.

8. A cathode potential control method for controlling a common cathode potential applied to a self-luminous display panel adapted to drive and control the light emission status of each of the pixels by active matrix driving, the cathode potential control method comprising the steps of:

reading a cathode potential level from a table memory according to a current panel temperature, the cathode potential level being associated with a panel temperature so as to cancel the temperature dependent characteristic of a voltage which develops between anode and cathode electrodes of a self-luminous element during light emission, the cathode potential level causing a drive transistor of the self-luminous element to operate in the saturation region; and developing a cathode potential associated with the read cathode potential level and supplying the potential to a common cathode electrode of the self-luminous display panel.

9. A cathode potential control device for controlling a common cathode potential applied to a self-luminous display panel adapted to drive and control the light emission status of each of the pixels by active matrix driving, the cathode potential control device comprising:

cathode potential determination means for reading a cathode potential level from a table memory according to a current panel temperature, the cathode potential level being associated with a panel temperature so as to cancel the temperature dependent characteristic of a voltage which develops between anode and cathode electrodes of a self-luminous element during light emission, the cathode potential level causing a drive transistor of the self-luminous element to operate in the saturation region; and cathode potential application means for developing a cathode potential associated with the determined cathode potential level and supplying the potential to a common cathode electrode of the self-luminous display panel.

* * * * *